US006403279B1

(12) United States Patent
Iwagaki

(10) Patent No.: US 6,403,279 B1
(45) Date of Patent: Jun. 11, 2002

(54) DIFFUSION TRANSFER PHOTOGRAPHIC PRODUCT

(75) Inventor: Masaru Iwagaki, Hino (JP)

(73) Assignee: Konica Corporation, Tokyo (JP)

( * ) Notice: Subject to any disclaimer, the term of this patent is extended or adjusted under 35 U.S.C. 154(b) by 0 days.

(21) Appl. No.: 09/705,168

(22) Filed: Nov. 2, 2000

(30) Foreign Application Priority Data

Nov. 8, 1999 (JP) ..... 11-316961

(51) Int. Cl.[7] ..... G03C 8/06; G03C 8/10; G03C 1/035

(52) U.S. Cl. ..... 430/217; 430/230; 430/567

(58) Field of Search ..... 430/217, 230, 430/567

(56) References Cited

U.S. PATENT DOCUMENTS 4,124,383 A * 11/1978 Penk ..... 430/217
5,266,450 A * 11/1993 Takehara ..... 430/567
6,284,449 B1 * 9/2001 Nakayama et al. ..... 430/567

* cited by examiner

*Primary Examiner*—Richard L. Schilling
(74) *Attorney, Agent, or Firm*—Frishauf, Holtz, Goodman Langer & Chick, P.C.

(57) ABSTRACT

A diffusion transfer photographic product is disclosed, comprising a photosensitive element, an image receiving element and a container having a processing composition, wherein the photosensitive element comprises a support having thereon at least a silver halide emulsion layer containing a silver halide emulsion comprising silver halide grains and at least 50% of total grain projected area is accounted for by silver halide regular crystal grains containing 5 mol % or less chloride and 0.5 mol % or more iodide and exhibiting a proportion of a (100) face per grain of not less than 50%, a variation coefficient of the proportion of a (100) face among grains being not more than 20%.

12 Claims, 6 Drawing Sheets

: UPWARD-ORIENTED (100) FACE REGION

DIFFUSION TRANSFER PHOTOGRAPHIC PRODUCT

FIELD OF THE INVENTION

The present invention relates to a diffusion transfer silver halide photographic products containing a silver halide emulsion and in particular, to diffusion transfer photographic products exhibiting an enhanced sensitivity, higher maximum density, superior discrimination along with the improved white background developing temperature dependence.

BACKGROUND OF THE INVENTION

Diffusion transfer process photographic light sensitive materials are known in the photographic art. A general feature of diffusion transfer photographic process is that the final image results from formation of imagewise partition of an image-providing material and diffusion transfer of the imagewise partition to an image-receiving layer.

In general, diffusion transfer images can be obtained by allowing a photosensitive element or a negative film component (having at least a photosensitive silver halide layer) to be exposes to chemical irradiation to form a developable image. Thereafter, the image is developed by being coated with an aqueous alkaline processing liquid to form an image forming partition of a soluble and diffusible image dye-providing material and then transferring the image forming partition to transmit the transferred image through diffusion to an image receiving layer overlapped onto an image receiving element or a positive film component.

In the foregoing diffusion transfer type photographic material, discrimination of the images depends on inhibition of generation or transfer of dyes in the white background areas. However, background whiteness of current diffusion transfer type photographic materials has not reached the level of commercially available color print materials. A technique of capturing a given amount of transfer dyes is supposed as a means for reducing the white background density and there have been proposed various ideas with regard to this technique. U.S. Pat. Nos. 3,930,864 and 3,958,995, for example, disclose to provide a dye-trapping layer to improve the white background. However, it was proved that, in the diffusion type silver halide photographic materials, there was a problem that providing the dye-trapping layer increased the overall thickness of the photosensitive element, leading to a decrease of the maximum density (Dmax). To avoid such a problem, JP-A No. 4-20956 (hereinafter, the term, JP-A means an unexamined, published Japanese Paten Application) discloses the use of a mordant dye polymer. Such a technique was effective but was not always sufficient.

Conventional color photographic materials including color negative films, color reversal films, color paper, color positive films and color reversal paper are processed at a constant developing temperature. On the contrary, the developing temperature range of diffusion transfer type silver halide photographic materials is so broad that sensitivity stability on variation of the developing temperature is strongly required.

Recently, requirements for photographic silver halide emulsions are more stringent and still higher levels of photographic performance are desired.

The use of tabular silver halide grains as means for enhancing the sensitivity of silver halide emulsion and in particular for enhancing the quantum sensitivity thereof are described in U.S. Pat. Nos. 4,434,226, 4,439,520, 4,414,310, 4,433,048, 4,414,306 and 4,459,353; JP-A 58-111935, 58-111936, 58-111937, 58-113927 and 59-99433. Techniques of introducing dislocation lines are generally known as a means for enhancing sensitivity and graininess. U.S. Pat. No. 4,956,269, for example, discloses the introduction of dislocation lines into tabular silver halide grains.

The tabular grain technique described above is effective to achieve enhanced sensitivity of silver halide emulsions. However, when the dislocation lines are applied to silver halide grains having a relatively high aspect ratio (i.e., a ratio of grain diameter to grain thickness) to make the most of desired characteristics of the tabular grains, it was found that deterioration was caused in other photographic performance such as contrast, process stability or pressure resistance.

It is commonly known that application of pressure to silver halide grains causes fogging or desensitization. However, there was a problem that dislocation lines-introduced grains exhibited marked desensitization when subjected to pressure.

JP-A 59-99433, 60-35726 and 60-147727 disclose techniques for improving pressure characteristics using core/shell type grains. JP-A 63-220238 and 1-201649 disclose techniques for improving graininess, pressure characteristics and exposure temperature dependence as well as sensitivity by introducing dislocation lines into silver halide grains. Further, JP-A 6-235988 discloses a technique for enhancing pressure resistance by use of multilayer-structured, monodisperse tabular grains having a high iodide-containing intermediate shell.

Photogr. Sci. Eng. 18, 215–225 (1974) disclosed that cubic silver halide grains exhibited little desensitization in inherent sensitivity and high contrast when a sensitizing dye was allowed to be adsorbed thereon. However, specifically in the case of cubic grains, cubic grains containing 5% or less chloride, it was difficult to prepare completely cubic grains. Herein completely cubic grains refers to cubic-formed grains having overall external faces substantially formed of (100) faces. Accordingly, incompletely cubic grains refers to grains having external faces other than (100). In most cases, the face index other than (100) is (111) or (110) faces. In fact, such silver halide grains having external faces of plural face indices are different in their face proportion from each other.

JP-A 5-341417 discloses that a high proportion of (100) faces is effective in enhancing performance, but there is nothing described with respect to effects of the distribution of the face proportion per grain among all the grains.

JP-A 5-107670, 4-317050, 5-53232, 4-372943 and 4-362628 disclose techniques for introducing dislocation lines into regular crystal grains. However, it was proved that these techniques did not reach the desired levels of recent requirements for higher sensitivity, higher contrast and improved process stability and pressure resistance.

SUMMARY OF THE INVENTION

It is an object of the present invention to provide a diffusion transfer process silver halide photographic product exhibiting an enhanced sensitivity, higher maximum density, superior discrimination along with the improved white background, and developing temperature dependence.

The object of the present invention can be accomplished by the following constitution:

1. A diffusion transfer photographic product comprising a photosensitive element, an image receiving element and a container having a processing composition, wherein the photosensitive element comprises a support having thereon at least a silver halide emulsion layer containing a silver halide emulsion comprising silver halide grains and at least 50% of total grain projected area is accounted for by silver halide regular crystal grains containing 5 mol % or less chloride and 0.5 mol % or more iodide and exhibiting a proportion of a (100) face per grain of not less than 50%, a variation coefficient of the proportion of a (100) face among grains being not more than 20%;

2. The photographic product described in 1, wherein the regular crystal grains each have an internal high iodide phase having an average iodide content of not less than 7 mol % and accounting for 0.1 to 15% of the grain volume; said high iodide phase being in the region at a depth of from 7 to 27% from the (100) face, based on the distance between the center of a grain and the (100) face;
3. The photographic product described in 2, wherein the high iodide phase is at a position facing a (100) face of the grain;
4. The photographic product described in 2, wherein the high iodide phase is at a position facing a corner, an edge, a (111) face or a (110) face;
5. The photographic product described in 2, wherein the high iodide phase is in the overall region as defined in claim 1;
6. The photographic product described in 2, wherein the high iodide phase has a thickness of not more than 0.1 $\mu$m;
7. The silver halide emulsion described in 1, wherein the regular crystal grains each have dislocation lines which are oriented toward the surface of the grain;
8. The photographic product described in 7, wherein the silver halide grains have at least 10 dislocation lines per grain, at least 60% of the dislocation lines being oriented toward the (100) face of the grain;
9. The photographic product described in 7, wherein the silver halide grains have at least 10 dislocation lines per grain, at least 60% of the dislocation lines of the grain being oriented toward a corner, an edge, a (111) face or a (110) face of the grain;
10. The photographic product of claim 1, wherein the regular crystal grains exhibit a variation coefficient of grain size of not more than 20%;
11. The photographic product of claim 1, wherein when the container is ruptured, the processing composition is distributed between the photosensitive element and the image-receiving element;
12. The photographic product of claim 1, wherein the processing composition exhibits a pH of not less than 12.

DETAILED DESCRIPTION OF THE INVENTION

Figure 1:
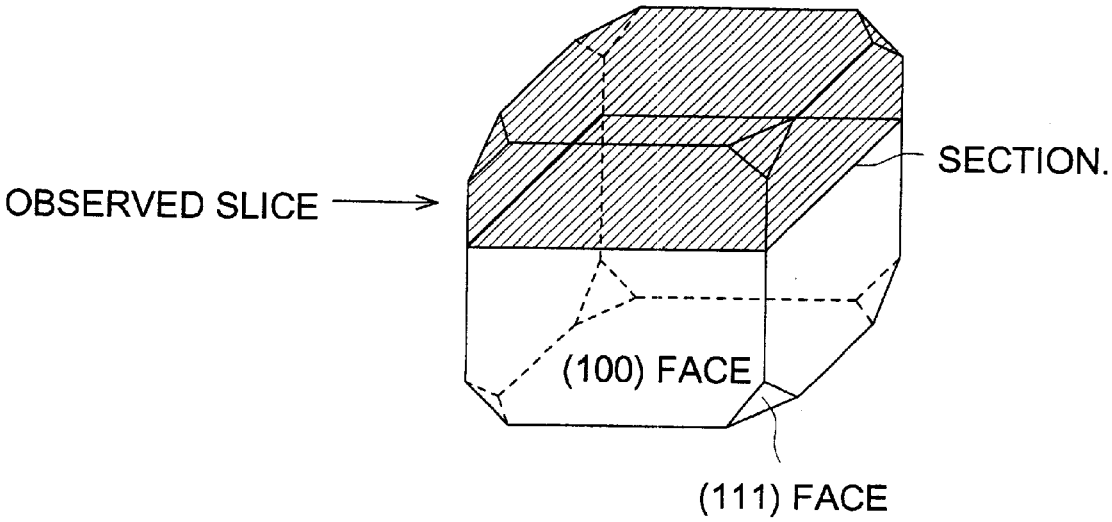
FIG. 1 illustrates a cubic-formed silver halide grain, which is sliced in parallel to a (100) face.
Figure 2:
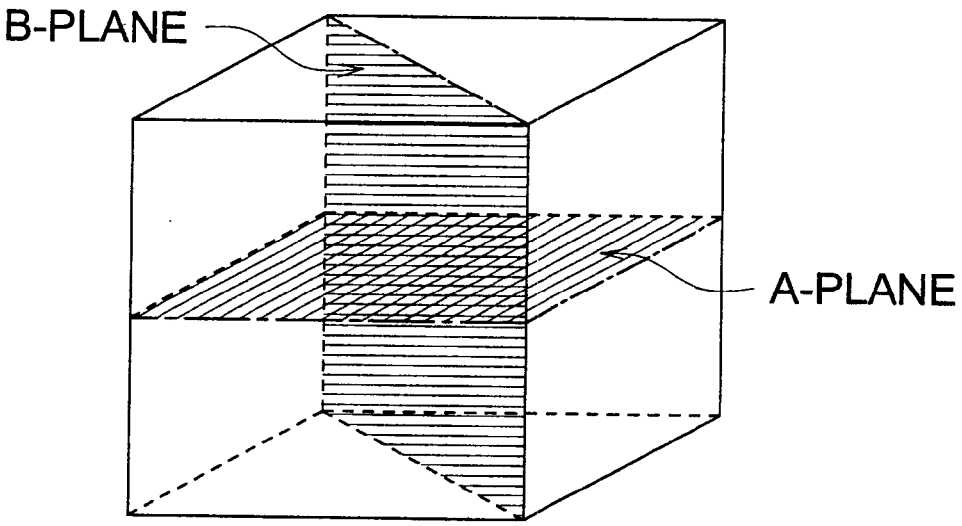
FIG. 2 illustrates sections A and B of a cubic grain.

The silver halide regular crystal grains used in the invention refer to those which have a rock salt type structure containing no twin plane. The regular crystal grains are preferably in a regular hexagonal or tetradecahedral form, and more preferably tetradecahedral from.

Silver halide grains used in the invention preferably contain dislocation lines. The number of dislocation lines per grain is preferably not less than 10, and more preferably not less than 30. The average iodide content in the region formed after introduction of the dislocation lines is preferably not more than 6 mol %, and more preferably not more than 4.5 mol %.

The dislocation lines in tabular grains can be directly observed by means of transmission electron microscopy at a low temperature, for example, in accordance with methods described in J. F. Hamilton, Photogr. Sci. Eng. 11 (1967) 57 and T. Shiozawa, Journal of the Society of Photographic Science and Technology of Japan, 35 (1972) 213. Silver halide tabular grains are taken out from an emulsion while ensuring to not exert any pressure that causes dislocation in the grains, and are then placed on a mesh for electron microscopy. The sample is observed by transmission electron microscopy, while being cooled to prevent the grain from being damaged (e.g., printing-out) by the electron beam. Since electron beam penetration is hampered as the grain thickness increases, sharper observations are obtained when using an electron microscope of a high voltage type.

In the case of regular crystal grains, it is often difficult to observe electron beam transmission images due to their grain thickness. In such a case, a silver halide grain is sliced to not more than 0.25 $\mu$m thick, in the direction parallel to the (100) face, while carefully applying pressure so as not to cause dislocation so that the dislocation lines can be confirmed by observing the thus obtained slice. The presence of the dislocation lines can be estimated by the analysis method employing a half-width of powder X-ray diffraction lines.

The regular crystal grains used in the invention preferably have not less than 10 dislocation lines per grain. The number of dislocation lines per regular crystal grain is defined as the number of the dislocation lines determined when a slice of each grain, as obtained above, is observed from the (100) direction. In this case, the number of grains to observe the dislocation is to be at 300 or more. The silver halide grains used in the invention, more preferably, have 30 or more dislocation lines per grain.

A variation coefficient of the number of dislocation lines is defined according to the following equation:

K(%) is defined as follows:

$$K(\%)=(\sigma/\alpha)\times 100$$

where $\sigma$ is a standard deviation of the number of dislocation lines per grain and a is an average value of the dislocation lines per grain. The variation coefficient of the number of dislocation lines is preferably not more than 30%, and more preferably not more than 20%.

The silver halide grains exhibiting the preferred variation coefficient of the number of dislocation lines can be prepared according to the following procedure. With regard to the time required for introducing the dislocation lines in the preparation of regular crystal grains according to the invention, the period from the time of starting addition of an iodide to the time of starting the growth of an outer layer adjacent to the dislocation lines is preferably not more than 10 min., and more preferably not more than 5 min in terms of uniformity in the number of the dislocation lines per grain. The pAg at the time of introducing the dislocation lines is preferably not more than 7.8 in terms of uniformity in the number of the dislocation lines per grain. To achieve uniform introduction of the dislocation lines in the grains, the crystal habit of the grains is preferably uniform, and the variation coefficient of the proportion of the (100) face among grains is preferably not more than 20%.

Introduction of the dislocation lines into silver halide grains used in the invention is started preferably at the time when 30 to 60% of the silver amount used for growing the silver halide grains (and more preferably within 40 to 70%) is consumed. The method for introducing the dislocation lines is not specifically limited, however, a method of introducing the dislocation by employing a steep gap of the silver halide lattice constant due to a steep difference in halide composition is preferred, in which a high iodide layer is formed at the time of starting the introduction of the dislocation lines and then a lower iodide layer is formed outside the high iodide layer. Preferred examples of the method for forming the high iodide include addition of an aqueous iodide (e.g., potassium iodide) solution, along with an aqueous silver salt (e.g., silver nitrate) solution by a double jet technique; addition of silver iodide fine grains; addition of an iodide solution alone and addition of a compound capable of releasing an iodide ion, and of these, the addition of silver iodide fine grains is more preferred.

The silver halide grains according to the invention may have an outermost surface layer having a thickness of 30 nm or less and a different iodide content from that of a layer adjacent thereto. The outermost layer preferably exists in the region accounting for at least 50%, and more preferably at least 70% of the total surface of the grain. The outermost layer preferably has a thickness of 10 nm or less and an iodide content of 10 mol % or less. The outermost layer preferably contains a metal ion and the metal ion is more preferably an iridium ion. The method for forming the outermost layer is not specifically limited, however, a method of allowing a layer having a different iodide content to grow immediately before completing the grain growth is preferred. Preferred examples of the growing method include addition by double jet process and an addition of fine silver halide grains. Of these additions, an addition of fine silver halide grains of a grain size of 0.07 $\mu$m or less is preferred. The fine silver halide grains preferably contain not more than 3 mol % iodide. The fine silver halide grains contain a metal ion and the metal ion is more preferably an iridium ion. The existence of the outermost layer having a different iodide content and its thickness can be confirmed by measuring the iodide content in the direction of the depth.

The measuring method will be further described. To take silver halide grains out of a silver halide emulsion, gelatin, used as a dispersing medium, is degraded with a proteinase under a safelight and removal of supernatant by centrifugation and washing with distilled water are repeated. In cases where silver halide grains are present in a coating layer containing gelatin as a binder, the grains can be taken out in a similar manner using the proteinase. In cases where a polymeric material other than gelatin is contained therein, it can be removed by dissolving the polymeric material with an appropriate organic solvent. In cases where a sensitizing dye or dyestuff is adsorbed onto the grain surface, these materials can be removed using an alkaline aqueous solution or alcohols to produce a clean silver halide grain surface. Silver halide grains dispersed in water are coated on a conductive substrate and dried. It is preferred to arrange the grains on the substrate without causing aggregation of the grains. The thus prepared grain sample is observed using an optical microscope or a scanning electron microscope. A dispersing aid may be employed to prevent grain aggregation. The use of commonly used anionic surfactants and cationic surfactants are not preferred, which often reduce stability of the secondary ion intensity in the SIMS measurement described later. An aqueous 0.2% or less gelatin solution is preferably used as a dispersing aid. After degradation with a proteinase, a silver halide grain dispersion which has been diluted with distilled water may be coated on the conductive substrate. The conductive substrate surface which is smooth and contains no element exhibiting a high secondary ion yield, such as an alkali metal, is preferred and a mirror plane-polished, low-resistive silicon wafer exhibiting resistivity of not more than 1.0 Ωcm which has been sufficiently washed is preferably employed. A rotation drier or a vacuum freeze drier may optimally be employed to allow the grains to be arranged on the substrate without causing aggregation. It is preferred that the grains be closely arranged without overlapping. To achieve such arrangement, a rotation drier or a vacuum freeze drier may optimally be employed.

Next, a measurement apparatus will be described. To detect a trace amount of an element contained in the grains can be employed a secondary ion mass spectrometry (hereinafter, also denoted as SIMS). A multi-channel detecting system is needed, which can simultaneously detect plural kinds of the secondary ions released from the position destroyed by the primary ion, therefore, it is not preferred to employ a single channel detecting system described in Levi Setti et al., Proceeding of East & West Symposium ICPS '90. In view of the foregoing, more preferred SIMS employed in the invention is a time of freight-type secondary ion mass spectrometry (hereinafter, also denoted as TOF-SIMS).

Further, a measurement method will be described. An analysis of the grain in the direction of the thickness of the major face can be made by the TOF-SIMS using one or more ion sources. Preferably, using at least two ion sources, one of them is used for etching and the other is used for the measurement. The values of the beam current, exposure conditions, the exposure time and the primary beam scanning region are arbitrary. To detect a trace amount of an element, a high mass-resolving power is needed to prevent interference by adjacent large peaks. In the case of silicon Si (28 a.m.u.), for example, it needs to make measurement under conditions of obtaining a mass resolving power of 5,000 or more. Preferred ions for the TOF-SIMS measurement include metal ions such as $Au^+$, $In^+$ and $Ga^+$. Ions for etching are optional, including $Au^+$, $In^+$, $Ga^+$, $Cs^+$, $Ar^+$, $Xe^+$, $Ne^+$ and $O^+$. The beam current, exposure conditions, exposure time and the primary beam scanning region are to be controlled so as to obtain an analytical depth equivalent to the depth from the major face of the grain. For example, emulsions are prepared by varying the halide composition to form a covering layer using, as a host grain, giant silver bromide grains prepared by referring to J. F. Hamilton, Phil. Mag., 16, 1 (1967). Using the emulsions, the measurement of only the central portion of the grain is made based on given conditions. Thereafter, using an atomic force microscope (hereinafter, also denoted as AFM), the depth of a square crater produced in the central portion of the giant grain is measured and thereby can be determined the analytical depth corresponding to the measuring conditions and the halide composition of the respective covering layer. Any commercially available, commonly known apparatus can be employed as the AFM. It is preferred to make measurement in a contact mode using NV 2000 available from Olympus Corp., in which grains to be measured can be confirmed by an optical microscope. Observation of silver halide grains with the AFM is described in Takada: J. Soc. Photo. Sci. Tech. Japan, 158 [2] 88 (1995). Instead of using a giant grain as a host grain, a thin layer can be employed, which can be obtained by allowing silver bromide to be vapor-deposited on the cleavage plane of a rock salt heated at 300° C. under high vacuum and then dissolving the rock salt.

Exemplarily, $Cs^+$ was used as an ion source for etching and $Ga^+$ was used as an ion source for measurement. The ions for etching need to be irradiated within a broader region than the irradiation region of the ions for measurement. In this regard, $Cs^+$ was irradiated at a 400 micro-angle for etching and $Ga^+$ was irradiated at a 60 micro-angle for measurement. Using the $^{115}$In peak, an area intensity (peak area) was measured for every constant depth. In cases when the peak intensity is low, an area at the lower mass side to the intended peak is also measured to avoid the influence of the background and is to be subtracted from the $^{155}$In peak value to determine a true peak intensity of In. The profile in the depth direction is determined from the etching conditions (an etching rate) and the etching time, enabling confirmation of the existence of outermost layers different in the iodide content and to determine their thickness.

The silver halide emulsion used in the invention has an average silver iodide content of not more than 5 mol %. In cases where the dislocation lines are introduced into silver halide grains used in the invention, the average iodide content in the inner region toward the position of introducing the dislocation lines is preferably not more than 5 mol %.

The proportion of the (100) face per grain of silver halide emulsion grains can be determined by electron microscopic observation of the grains. Thus, at least 50% by area of the surface of a grain is preferably accounted for by a (100) face. More preferably, at least 60%, and still more preferably 70 to 95% of the grain surface is accounted for by the (100) face. The proportion of the (100) faces of the total silver halide emulsion grains can also be determined by commonly known powder X-ray diffractometry or a method employing dye absorption. Preferably, at least 50% of total grain surface area is accounted for by the (100) face.

A variation coefficient of a proportion of a (100) face of a silver halide grain, among total grains, is preferably not more than 20%, more preferably not more than 15%, and still more preferably not more than 10%. The variation coefficient can be determined in the following manner. The proportion of (100) faces of each grain can be determined in such a manner that metal is deposited from the oblique direction (i.e., shadowing treatment) and observed with SEM (Scanning Electron Microscope), after which the observed images are subjected to image processing. When subjecting grains to the shadowing treatment and observing the grains from the upper side by employing the shadow caused by the amount of metal deposited, a (100) face and a non-(100) face could be successfully distinguished. The shadowing treatment is a technique for providing a shadow as grains which has commonly been used in replica observation of silver halide grains and described in "Collective Electron Microscope Sample Technique" published by Seibundo Shinkosha, page 123 (1970).

The proportion of a (100) face of the grain can be determined according to the following procedure. To take silver halide grains out of a silver halide emulsion, gelatin used as a dispersing medium is degraded with a proteinase under a safelight, and subjected to repeated removal of supernatant by centrifugation and washing with distilled water. In cases where silver halide grains are present in a coating layer containing gelatin as a binder, the grains can be taken out in a similar manner using a proteinase. In cases where a polymeric material other than gelatin is contained therein, it can be removed by dissolving the polymeric material with an appropriate organic solvent. In cases where a sensitizing dye or dyestuff is adsorbed onto the grain surface, these materials can be removed using an alkaline aqueous solution or alcohols to produce a clean silver halide grain surface. Silver halide grains dispersed in water are coated on a conductive substrate and dried. It is preferred to arrange the grains on the substrate without causing aggregation of the grains. The thus prepared grain sample is observed using an optical microscope or a scanning electron microscope. A dispersing aid may be employed to prevent grain aggregation. After degradation with a proteinase, a silver halide grain dispersion which has been diluted with distilled water may be coated on the conductive substrate. A rotation drier or a vacuum freeze drier may optimally be employed to allow the grains to be arranged on the substrate without causing the aggregation. A conductive substrate surface which is smooth and contains no element exhibiting a high secondary ion yield, such as an alkali metal, is preferred and a mirror plane-polished, low-resistive silicon wafer exhibiting resistivity of not more than 1.0 Ωcm which has been sufficiently washed is preferably employed. A smooth polyethylene terephthalate base on which carbon is thinly deposited to provide conductivity may also be used.

Onto the silver halide grains dispersed on a substrate, metal is allowed to deposit from the direction of an angle of 45°. Metals to be deposited are generally Cr and Pt-Pd and preferably are platinum carbon in terms of graininess of the deposited membrane as well as linearity of evaporation. When the metal-deposited membrane is too thin, the contrast difference necessary to distinguish the (100) face from non-(100) faces cannot be obtained. On the other hand, a thick membrane increases errors in measurement, therefore, the thickness is preferably 20 nm or so. The SEM is preferably a higher resolution apparatus to enhance measurement precision. Observation is made at an electron beam accelerating voltage of 1.8 kV, whereby a sufficient contrast difference is obtained to make easy distinction of turned-up (100) faces, external form of grains or substrate in the subsequent image processing stage. Observation is made from the upper side, without inclining the sample. Observed images are photographed using a Polaroid film or a conventional negative film and may then be read with a scanner into a computer for image processing. To prevent deterioration of such read images, it is preferred to save them as digitized images on line, connecting the SEM to a computer for image processing. The read images are then subjected to a median filter to remove impulse errors of images. Thereafter, binary-coding is made at a threshold value enabling image extraction of turned-up (100) faces and the grain contour, after which an area of each grain is measured numbering the grains. Inputting measured (100) face areas and an area within the grain contour into a text calculation software in the form of ASCII, the (100) face proportion of each grain can be determined.

As a variation coefficient of the (100) face proportion among grains, K % is defined by the following formula:

$$K(\%)=[\sigma_{(100)}/\alpha_{(100)}]\times 100$$

where $\sigma_{(100)}$ is a standard deviation (%) of a (100) face proportion and $\alpha_{(100)}$ is an average value of (100) face proportions (%)

The variation coefficient is preferably not more than 15%, and more preferably not more than 10%. Specifically, in cubic silver halide grains containing dislocation lines, it is preferred to reduce the variation coefficient of the (100) face proportion among grains. The (100) face proportion of a grain is preferably not less than 50%, and more preferably 60 to 95%. It is preferred to reduce the (100) face proportion according to the following method.

The pAg of forming cubic grains is preferably 6.8 to 7.8 in terms of stability of the face proportion. In addition, a method of supplying an iodide to a reaction mixture to grow grains is essential; the use of fine silver iodide grains or the use of an iodide releasing agent is effective for reducing the variation coefficient of the (100) face proportion among grains. This effect is supposed to result from the iodide ion distribution being made homogeneous in a mixing vessel. It is particularly important in the preparation of silver halide grains containing dislocation lines. To enhance homogeneity of the contents in the mixing vessel, it is preferred to use a means such as increasing a linear speed of stirring a solution in the mixing vessel or reducing the silver halide concentration in the mixing vessel. The stirring speed (or rotation speed) is preferably increase to the point of causing no foam. The silver halide concentration is preferably 0 to 2 mole per liter immediately before starting grain growth, 0 to 1.5 mole per liter immediately after completing grain growth and 0 to 5 mole per liter during grain growth.

Iodide ions are preferably supplied using fine silver iodide grains or an iodide ion releasing agent to reduce a variation coefficient of the (100) face proportion distribution among grains. Examples of the iodide ion releasing agent usable in the preparation of silver halide grains are shown below, but are not limited to these.

(1)

$ICH_2COOH$ (2)

$ICH_2CONH_2$ (3)

$ICH_2CN$ (4)

$I(CH_2)_2COOH$ (5)

$I(CH_2)_3COOH$ (6)

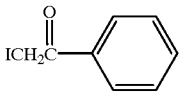

(7)

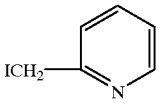

(8)

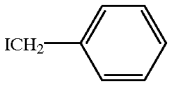

(9)

$I(CH_2)_2SO_3Na$ (10)

$I(CH_2)_2SO_2CH_3$ (11)

$I(CH_2)_2OH$ (12)

$I(CH_2)_3OH$ (13)

$I(CH_2)_4OH$

-continued (14)

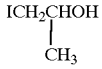

(15)

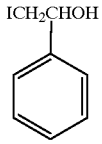

(16)

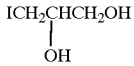

(17)

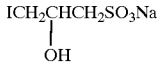

(18)

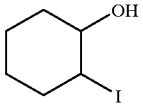

(19)

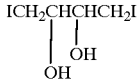

(20)

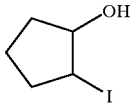

(21)

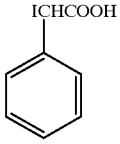

(22)

$I(CH_2)_2SO_2CH_2CONH_2$ (23)

$I(CH_2)_2NH_2$ (24)

$I(CH_2)_2NHSO_2CH_3$ (25)

$I(CH_2)_2NHCOCH_3$ (26)

$I(CH_2)_2OCH_3$ (27)

$I(CH_2)_2SCH_3$ (28)

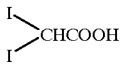

(29)

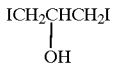

(30)

$I(CH_2)_2SO_2NH_2$

-continued
(31)
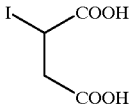
(32)
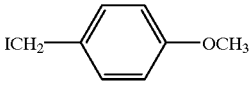
(33)
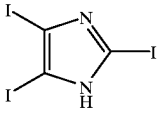
(34)
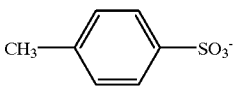
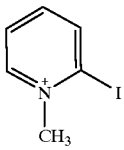
(35)
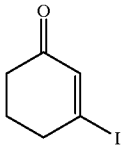
(36)
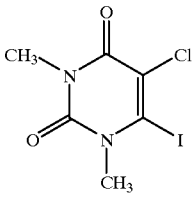
(37)
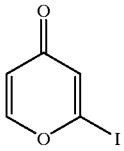
(38)
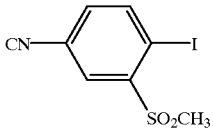
(39)
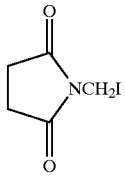
-continued
(40)
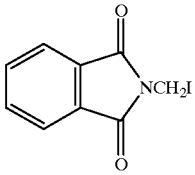
(41)
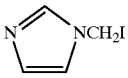
(42)
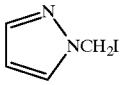
(43)
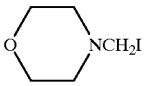
(44)
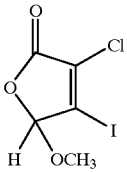
(45)
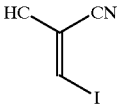
(46)
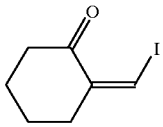
(47)
$I(CH_2)_5COOH$
(48)
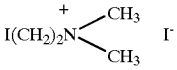
(49)
$I(CH_2)_2N(CH_3)SO_2CH_3$
(50)
$I(CH_2)_2OCOCH_3$
(51)
$I(CH_2)_2N(CH_3)COCH_3$
(52)
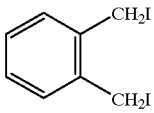
(53)
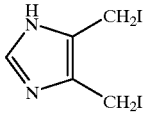

-continued (54)

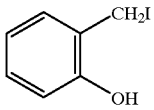

(55)

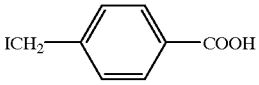

(56)

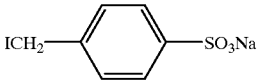

(57)

$ICH_2CONH(CH_2)_2—SO_3Na$ (58)

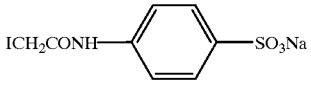

(59)

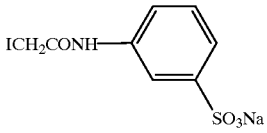

(60)

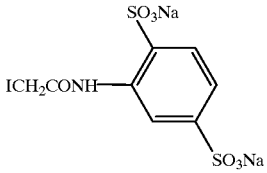

(61)

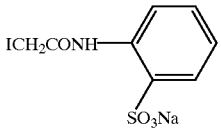

(62)

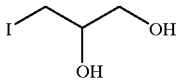

(63)

$Br(CH_2)_2OH$ (64)

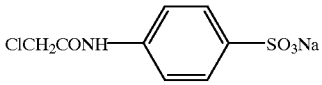

(65)

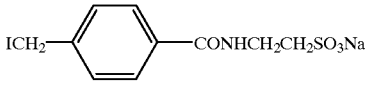

(66)

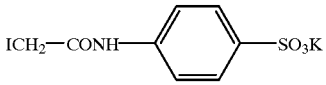

-continued (67)

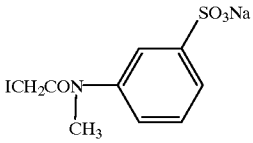

(68)

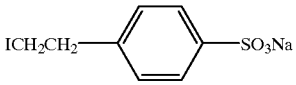

(69)

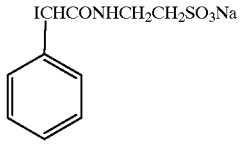

(70)

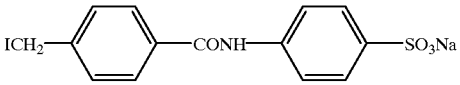

(71)

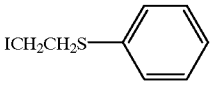

Silver halide grains used in the invention preferably, each internally includes a silver halide phase having an iodide content of not less than 7 mol % and accounting for 0.1 to 15%, more preferably 0.1 to 8%, and still more preferably 0.1 to 5% of the volume of the grain.

This high iodide containing phase of 7 mol % or more iodide (preferably 10 mol % or more iodide) is localized in a region of from 40 to 80% (preferably 40 to 60%) of silver used for growing grains. Alternatively, the high iodide phase is in the region R at a depth as defined below:

$$r_1 \leqq R \leqq r_2$$

wherein $r_1$ represents a position at a depth of 0.07 r from the (100) surface of the grain and $r_2$ represents a position at a depth of 0.27 r from the (100) surface, in which r is the length of a perpendicular line drawn from the center of the grain to the (100) surface. Thus, the high iodide phase is in the region at a depth of from 0.07 r to 0.27 r from the (100) face. Herein, the center of the grain is to be the center of gravity of the grain.

A method of forming the high iodide containing phase of 7 mol % or more iodide is not specifically limited. Similar to the method of introducing dislocation lines, it is preferred to allow the high iodide phase to be localized by adding an aqueous iodide (such as potassium iodide) solution and a silver salt solution by the double jet addition, adding fine silver iodide grains, adding an aqueous soluble iodide salt solution by itself or using an iodide ion releasing agent. Of these, the addition of fine silver iodide grains is more preferred.

Further, to form the high iodide containing phase, it is preferred to add the fine silver iodide grains or aqueous soluble iodide salt or iodide ion releasing agent at a time after addition 40% of a silver salt to be used for grain growth and before 80% of the silver salt during the course of grain growth.

It is preferred to form a band-formed high iodide contour within the grain by localizing the high iodide containing phase. The high iodide contour can be observed using a transmission electron microscope at a low temperature in a manner similar to the observation of dislocation lines mentioned before. Preferably, at least 50% of the total grain projected area (more preferably at least 60%, and still more preferably 80% thereof) is accounted for by grains containing the high iodide contour. The width of the contour is preferably 0.05 μm or less and more preferably 0.02 μm or less.

Figure 3A:
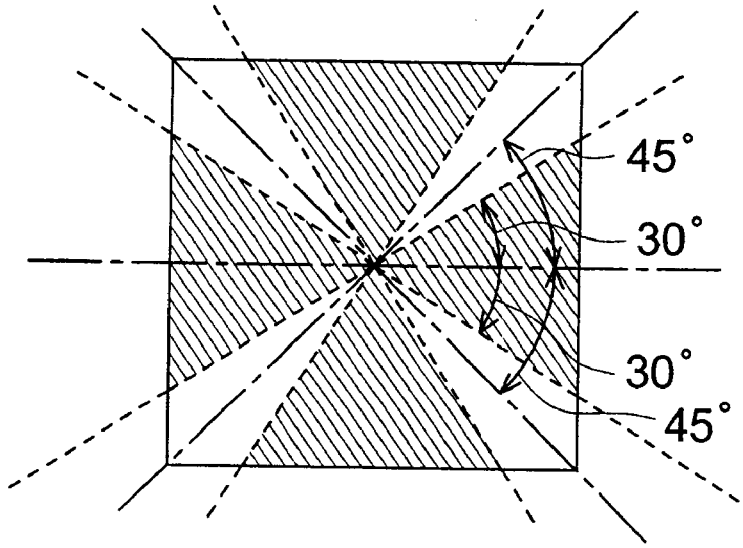
FIGS. 3A and 3B illustrate section A and section B, respectively.
Figure 3B:
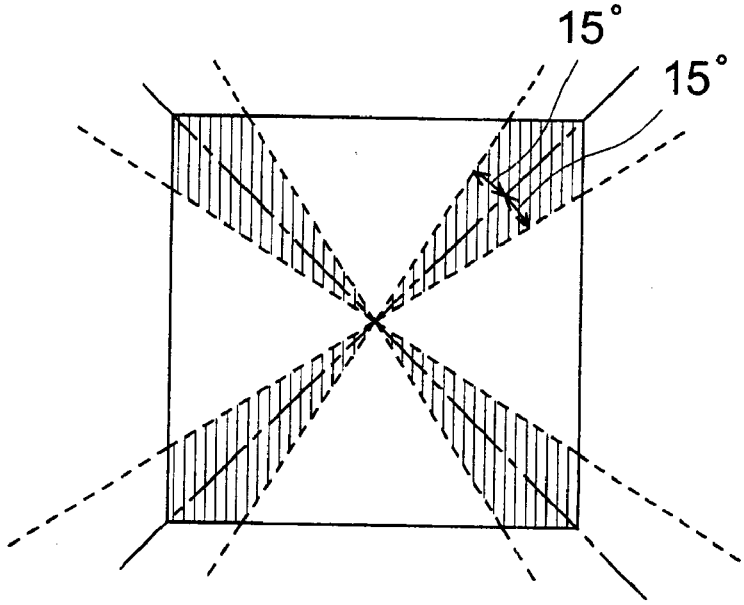
Figure 4:
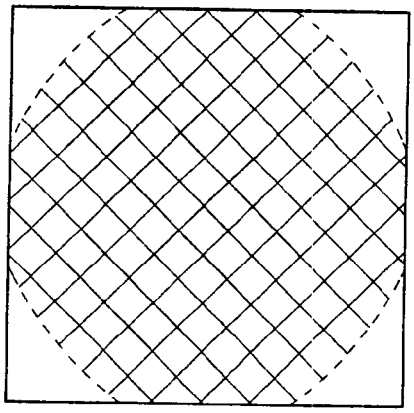
FIG. 4 illustrates an outline of the projected plane of upward-oriented (100) face of a cubic grain.
Figure 5:
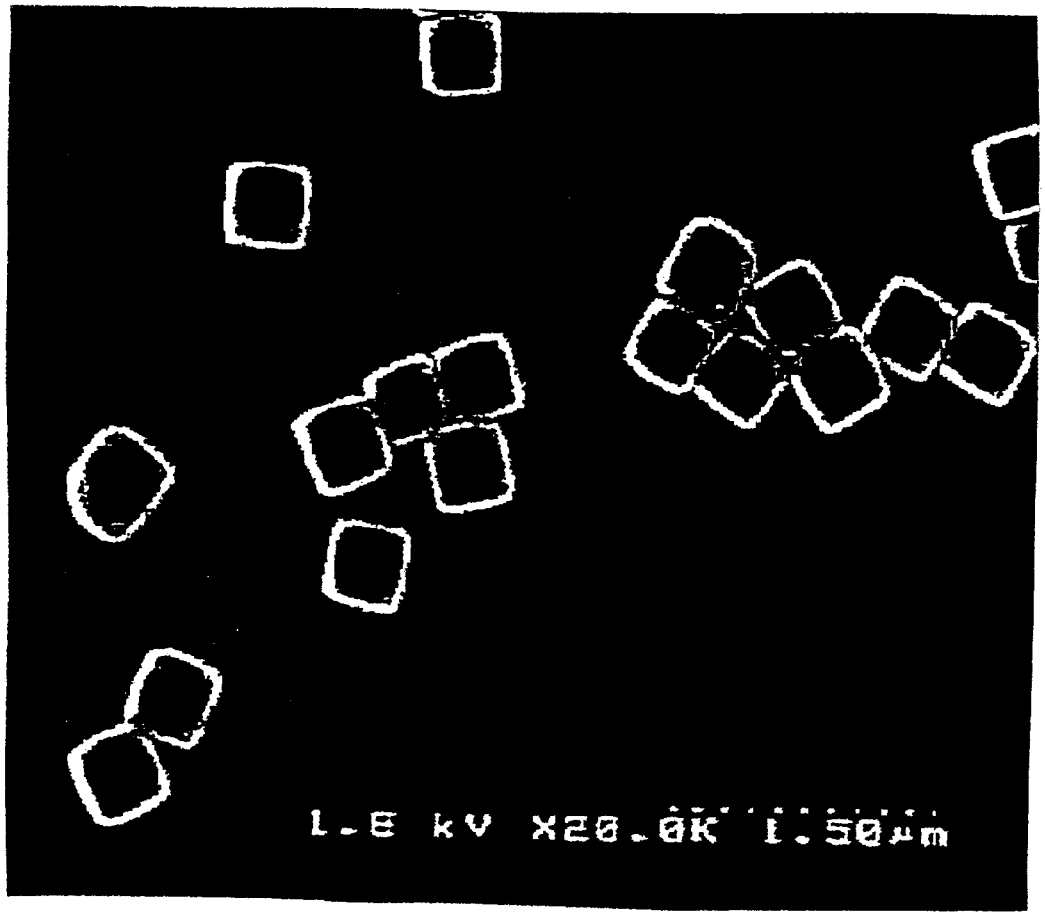
FIG. 5 is an electron micrograph of grains exhibiting a low (100) face proportion.
Figure 6:
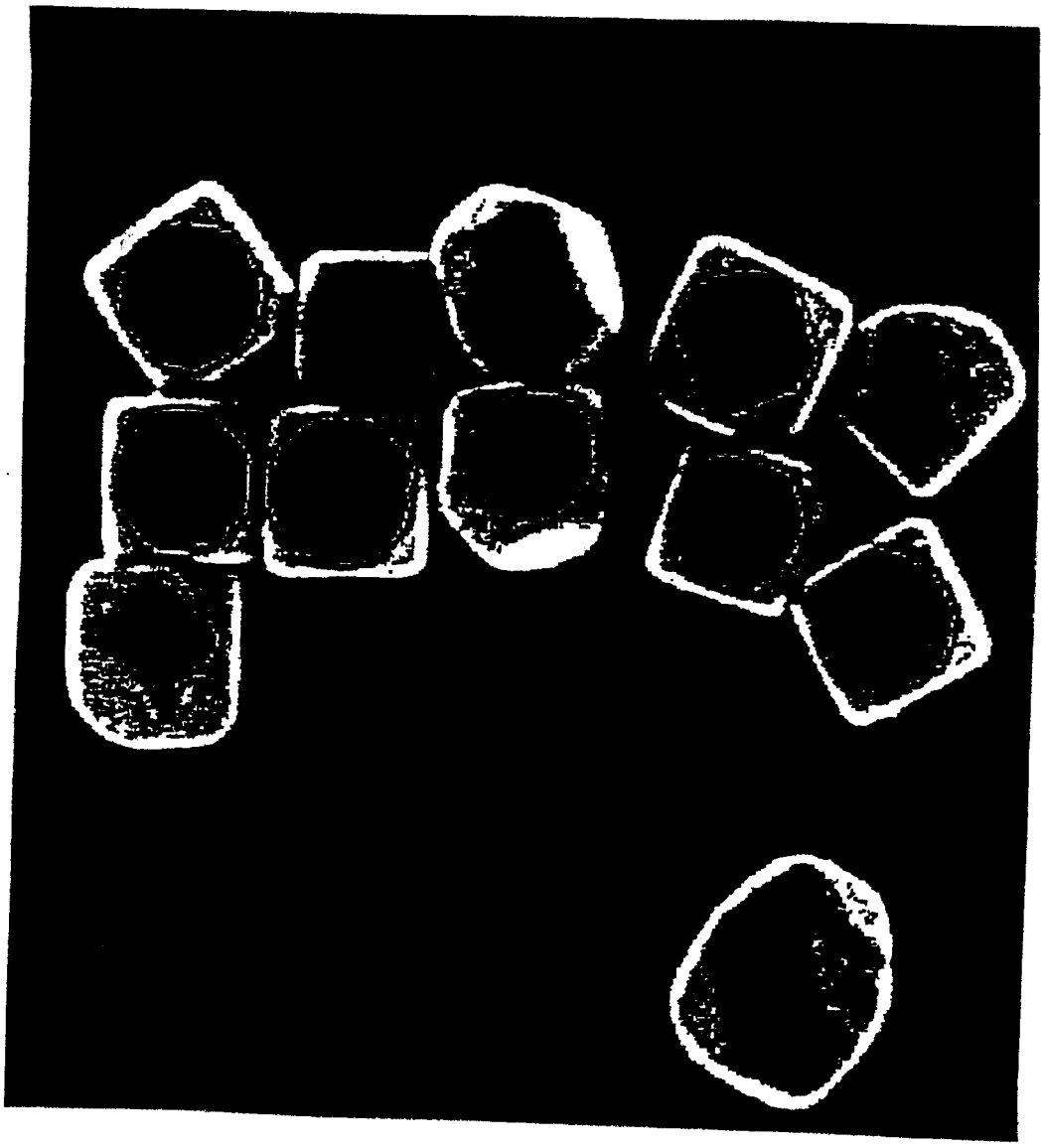
FIG. 6 is an electron micrograph of grains exhibiting a high (100) face proportion.

The iodide distribution in the high iodide contour may be uniform or non-uniform. In cases of non-uniform distribution, silver halide grains having a high iodide phase of 7 mol % or more iodide only at the position facing a (100) face, and cubic-formed silver halide grains having the high iodide phase only at the position facing a corner or edge, or a (111) or (110) surface. The iodide distribution within the grain can be determined by slicing the grain no more than 0.25 μm thick and measuring the iodide content at various positions on the slice. The position facing the (100) face, and the position facing to the corner or the edge or facing to the (111) face or (110) face are defined as follows: Position facing a (100) face:

A cubic-formed silver halide grain is sliced so as to pass through a central portion of the (100) face, as shown in the A-plane in FIG. 3 and in its section (FIG. 4A), the hatched region is defined as a position facing a (100) face. Position facing a corner, edge, (111) face or (110) face:

A cubic-formed silver halide grains is sliced in the direction of from a corner to a corner opposite thereto, as shown in the B-plane in FIG. 3, and in its section (as shown in FIG. 4B), the hatched region and the non-hatched region each are defined as a position facing a corner, an edge, a (111) face or a (110) face.

Silver halide grains relating to the invention may be rounded on the corner or along the edge and may have a surface having a face index other than (100), such as a (111) or (110) face. In such a case, when the six major faces of the cubic-formed grain are extended, the intersection is defined as a corner or an edge and the position facing a (100) face, and the position facing a corner, edge, (111) face or (110) face can thereby be defined.

In cases when the region facing the (100) face has a higher iodide content, the difference in iodide content between the region facing the (100) face and other regions is preferably not less than 4 mol %, and more preferably not less than 7 mol %. In cases when the region facing the corner, edge, (111) face or (110) face has a higher iodide content, the difference in iodide content between the region facing the corner, edge, (111) face or (110) face and other regions is preferably not less than 4 mol %, and more preferably not less than 7 mol %.

As a method for enhancing the iodide content at the position facing the corner, edge, (111) face or (110) face, an iodide is added to a solution containing cubic host grains having a higher (100) face portion and the grains are allowed to grow. In this case, the (100) face portion of the grains is preferably 90% or more. Alternatively, as described in JP-A 1-40938, after forming host grains, a (100) face-adsorbing compound is added, then the iodide is added thereto and subsequently, the grains are allowed to grow. As an iodide are preferably fine silver iodide grains. As a method for enhancing the iodide content at the position facing the corner, edge, (111) face or (110) face, an iodide is added to a solution containing cubic host grains having a higher (100) face portion and the grains are allowed to grow. In this case, the (100) face portion of the grains is preferably 90% or more. Alternatively, as described in JP-A 1-40938, after forming host grains, a (100) face-adsorbing compound is added, then the iodide is added thereto and subsequently, the grains are allowed to grow. As an iodide are preferably fine silver iodide grains.

In silver halide grains used in the invention, it is preferred in terms of sensitivity that at least 60% of dislocation lines formed within the grain are oriented toward the corners, edges, (111) faces or (110) faces of the grain. Herein, the orientating direction, for example, in observation of dislocation lines on the sliced plane, means that the direction of the dislocation lines is oriented within +15° of the (111) direction (also denoted as <111>).

It is preferred in terms of pressure resistance that at least 60% of the dislocation lines of the grain are formed in the direction substantially perpendicular to a (100) face. The direction substantially perpendicular to a (100) face, for example, in observation of dislocation lines on the sliced plane, means that the direction of the dislocation lines is oriented within +15° of the (100) direction.

The direction and the angle of the dislocation lines can be controlled by adjusting the pAg at the time of introducing the dislocation lines or during the subsequent grain growth. Employing pAg-dependence of a grain growth rate in the (100) direction and the (111) direction, the pAg in the stage of grain growth after adding an iodide to introduce dislocation lines, can be selected to allowing the dislocation lines to grow in a given direction. The directivity can be further enhanced by combining the selectivity during grain growth described above with the use of the form of the grain and a face-selective compound.

The silver halide emulsion grains preferably contain not more than 5 mol % chloride and not less than 0.5 mol % (more preferably, 1 to 5 mol %) iodide.

The silver halide emulsion used in this invention is preferably comprised of monodisperse silver halide grains. The expression "monodisperse" means that the weight of silver halide grains included within ±20% of the mean grain size accounts for at least 60%, preferably at least 70%, and more preferably at least 80% of the total grains. Herein, when the product of frequency ni of a grain having a grain size ri and $ri^3$ is maximum, the grain size, ri is defined as mean grain size r (in which significant figure is three digits and the final digit number is rounded). Specifically, in cases where the silver halide grain is cubic, the grain size is its edge length; and in the case of a grain other than the cubic grain, the grain size is an edge length of a cube having a volume equivalent the grain projected area. The grain size is determined in such a manner that the grains are magnified to 10,000 to 50,000 times by an electron microscope and from electron micrograph, the grain size or grain projected area is measured (in which at least 1,000 grains are selected at random). The grain size of silver halide grains contained in the emulsion used in this invention is not specifically limited, but preferably 0.1 to 2.5 μm, and more preferably 0.3 to 1.5 μm, based on cubic equivalent edge length. The monodisperse emulsion used in this invention preferably exhibits a monodisperse degree, as defined below, of 15% or less, and more preferably 10% or less:

$$(\text{standard deviation}/\text{mean grain size})\times 100=\text{monodisperse degree}\ (\%)$$

wherein the standard deviation and the mean grain size are determined from the grain size, ri, as defined above. As a silver halide emulsion used in this invention, two or more cubic grain emulsions having different grain sizes may be blended.

The preparation of silver halide grains relating to the invention can be made according to methods known in the art alone or in combination, as described in JP-A Nos. 61-6643, 61-146305, 62-157024, 62-18556, 63-92942, 63-151618, 63-163451, 63-220238, and 63-311244. Example thereof include simultaneous addition, a double jet method, a controlled double jet method in which the pAg of a liquid phase forming silver halide grains is maintained at a given value, and a triple jet method, in which soluble silver halides different in halide composition are independently added. Normal precipitation and reverse precipitation in which grains are formed in an environment of excessive silver ions are also applied. The pAg of the liquid phase forming silver halide grains can be controlled so as to meet the grain growth rate and this technique is preferred to prepare highly monodispersed grains. The addition rate is referred to techniques described in JP-A 54-48521 and 58-49938.

Silver halide solvents are optionally employed. Examples thereof include ammonia, thioethers and thioureas. The thioethers are referred to U.S. Pat. Nos.3,271,157, 3,790, 387, and 3,574,628. The mixing method is not specifically limited, and neutral precipitation, ammoniacal precipitation and acidic precipitation are applied. The pH is preferably not more than 5.5, and more preferably not more than 4.5 in terms of reduced fogging of silver halide grains.

Silver halide grains are generally formed in the presence of a dispersing medium. The dispersion medium is a substance capable of forming a protective colloid, and gelatin is preferably employed. Gelatin used as the dispersing medium include an alkali processed gelatin and acid processed gelatin. Preparation of gelatin is detailed in A. Veis, The Macromolecular Chemistry of Gelatin, published Academic press, 1964. Examples of hydrophilic colloidal materials other than gelatin include gelatin derivatives, a graft polymer of gelatin and other polymer, proteins such as albumin and casein, cellulose derivatives such as hydroxyethyl cellulose, cabboxymethyl cellulose and cellulose sulfuric acid esters, saccharide derivatives such as sodium alginate and starch derivatives and synthetic polymeric materials, such as polyvinyl alcohol, polyvinyl alcohol partial acetal, poly-N-vinyl pyrrolidone, poyacrylic acid, polymethacrylic acid, polyacrylamide, polyvinyl imidazole and polyvinyl pyrazole, including their copolymers. Gelatin is preferably one which exhibits not less tan 200 of a jerry strength, defined in the PAGI method.

At the stage of forming silver halide grains, washing, chemical ripening or coating, is preferably incorporated a metal ion selected from the metals of Mg, Ca, Sr, Ba, Al, Sc, Y, La, Cr, Mn, Fe, Co, Ni, Cu, Zn, Ga, Ru, Rh, Pd, Re, Os, Ir, Pt, Au, Cd, Hg, Tl, In, Sn, Pb and Bi. The metal is incorporated in the form of an ammonium, acetate, nitrate, sulfate, phosphate, hydroxide, or a metal complex salt such as six-coordinated complex and four-coordinated complex. Exemplary examples thereof include $Pb(NO_3)_2$, $K_2Fe(CN)_6$, $K_3RhCl_6$ and $K_4Ru(CN)_6$. A chalcogen compound may be added during the preparation of emulsions, as described in U.S. Pat. No. 3,772,031.

The silver halide grain emulsions may be subjected to desalting to remove soluble salts. Desalting can be applied at any time during the growth of silver halide grains, as described in JP-A No. 60-138538. Desalting can be carried out according to the methods described in Research Disclosure Vol. 176, item 17643, section II at page 23. Exemplarily, a noodle washing method in which gelatin is gelled, and a coagulation process employing an-inorganic salts, anionic surfactants (e.g., polystyrene sulfonic acid) or a gelatin derivative (e.g., acylated gelatin, carbamoyl gelatin) are used. Alternatively, ultrafiltration can also be applied, as described in JP-A No. 8-228468.

Silver halide emulsions used in the invention can be subjected to reduction sensitization. The reduction sensitization can be performed by adding a reducing agent to a silver halide emulsion or a mixture solution used for grain growth, or by subjecting the silver halide emulsion or a mixture solution used for grain growth to ripening or grain growth, respectively, at a pAg of not more than 7 or at a pH of not less than 7. The reduction sensitization can also be performed before or after the process of chemical sensitization, as described in JP-A 7-219093 and 7-225438. The reduction sensitization may be conducted in the presence of an oxidizing agent, and preferably, a compound represented by formulas (1) to (3) described below. Preferred reducing agents include thiourea dioxide, ascorbic acid and its derivatives and stannous salts. Examples of other reducing agents include borane compounds, hydrazine derivatives, formamidinesulfinic acid, silane compounds, amines and polyamines, and sulfites. The reducing agent is added preferably in an amount of $10^{-8}$ to $10^{-2}$ mol per mol of silver halide.

To ripen at low pAg, a silver salt may be added and aqueous soluble silver salts are preferably employed, such as silver nitrate. The pAg during ripening is not more than 7, preferably not more than 6, and more preferably between 1 and 3. To ripen at high pH, an alkaline compound may be added to a silver halide emulsion or a reaction mixture solution for grain growth. Examples of the alkaline compound include sodium hydroxide, potassium hydroxide, sodium carbonate, potassium carbonate and ammonia. In the case when adding ammoniacal silver nitrate to form silver halide, alkaline compounds other than ammonia are preferably employed.

The silver salt or alkaline compound may be added instantaneously or in a given time, and at a constant flow rate or a variable flow rate. The addition may be dividedly made. Prior to the addition of aqueous soluble silver salt and/or halide, the silver salt or alkaline compound may be allowed to be present in a reaction vessel. Further, the silver salt or alkaline compound may be incorporated to an aqueous silver salt solution and added together with the aqueous soluble silver salt. Furthermore, the silver salt or alkaline compound mat be added separately from the aqueous soluble silver salt or halide.

An oxidizing agent may be added to the silver halide emulsion during the formation thereof. The oxidizing agent is a compound capable of acting on metallic silver to convert to a silver ion. The silver ion may be formed in the form of a scarcely water-soluble silver salt, such as silver halide, silver sulfide or silver selenide, or in the form of an aqueous soluble silver salt, such as silver nitrate. The oxidizing agent may be inorganic compound or an organic compound. Examples of inorganic oxidizing agents include ozone, hydrogen peroxide and its adduct (e.g., $NaBO_2 \cdot H_2O_2 \cdot 3H_2O$, $2Na_2CO_3 \cdot 3H_2O_2$, $Na_4P_2O_7 \cdot 2H_2O_2$, $2Na_2SO_4 \cdot H_2O_2 \cdot H_2O$), peroxy-acid salt (e.g., $K_2S_2O_8$, $K_2C_2O_6$, $K_4P_2O_8$), peroxy-complex compound $\{K_2[Ti(O_2)OOCCOO] \cdot 3H_2O$, $4K_2SO_4 Ti(O_2)OH \cdot 2H_2O$, $Na_3[VO(O_2)(OOCCOO)_2 \cdot 6H_2O]\}$, oxygen acid such as permanganates (e.g., $KmnO_4$), chromates e.g., $K_2Cr_2O_7$), halogen elements such as iodine or bromine, perhalogenates (e.g., potassium periodate), high valent metal salts (e.g., potassium ferricyanate) and thiosulfonates. Examples of organic oxidizing agents include quinines such as p-quinone, organic peroxides such as peracetic acid and perbenzoic acid, and active halogen-releasing compounds (e.g., N-bromsuccimide, chloramines T, chroramine B). Of these oxidizing agents, ozone, hydrogen peroxide and its adduct, halogen elements, thiosulfonate, and quinines are preferred. Specifically, thiosulfonic acid compounds represented by the following formulas (1) to (3) are preferred, and the compound represented by formula (1) is more preferred: 0136-138

$$R^1—SO_2S—M \quad (1)$$

$$R^1—SO^2S—R^2 \quad (2)$$

$$R^1SO^2S—L_nSSO_2—R^3 \quad (3)$$

where $R^1$, $R^2$ and $R^3$, which may be the same or different, represent an aliphatic group, aromatic group or a heterocyclic group; M is a cation, L id a bivalent linkage group; and n is 0 or 1. The oxidizing agent is incorporated preferably in an amount of $10^{-7}$ to $10^{-1}$ mole, more preferably $10^{-6}$ to $10^{-2}$ mole, and still more preferably $10^{-5}$ to $10^{-3}$ mole per mole of silver. The oxidizing agent may be added during grain formation, or before or during forming structure having different halide compositions. The oxidizing agent can be incorporated according to the conventional manner. For examples, an aqueous soluble compound may be incorporated in the form of an aqueous solution; an aqueous insoluble or sparingly soluble compound may be incorporated through solution in an appropriate organic solvent (e.g., alcohols, glycols, ketones, esters and amides).

Silver halide grains used in the invention may be subjected to chemical sensitization. Chalcogen sensitization with a compound containing a chalcogen such as sulfur, selenium or tellurium, or noble metal sensitization with a compound of a noble metal such as gold are performed singly or in combination.

Silver halide grains used in this invention are preferably subjected to selenium sensitization. Examples of preferred selenium sensitizers include colloidal selenium, isoselenocyanates, selenoureas, selenoketones, selenoamides, selenophosphates, and selenides, as described in U.S. Pat. Nos. 1,574,944, 1,602,592 and 1,623,499; JP-A Nos. 60-150046, 4-25832, 4-109240 and 4-147250. Specifically preferred senium sensitizers are selenoureas, selenophosphates and selenides. As concrete techniques for using selenium sensitizers are applicable those which are described in U.S. Pat. Nos. 1,574,944, 1,602,592, 1,623,499, 3,297,499, 3,297,447, 3,320,069, 3,408,196, 3,408,197, 3,442,653, 3,420,670, 3,591,385; JP-B Nos. 52-34491, 52-34492, 53-295 and 57-22090 (herein, the term, JP-B means a published Japanese Pat.); JP-A Nos. 59-18-536, 59-185330, 59-181337, 59-187338, 59-192241, 60-150046, 60-151637, 61-246738, 3-4221, 3-24537, 3-111838, 3-116132, 3-148648, 3-237450, 4-16838, 4-25832, 4-32831, 4-96059, 4-109240, 4-140738, 4-147250, 4-149437, 4-184331, 4-190225, 4-191729 and 4-195035; and H. E. Spencer et al. J. Photo. Sci. vol. 31, 158–169 (1983).

The amount of a selenium compound to be added, depending on the kind of the compound, the kind of a silver halide emulsion and chemical ripening conditions, is preferably $10^{-8}$ to $10^{-4}$ mole per mol of silver. The selenium compound may be added through solution in water or an organic solvent such as methanol, ethanol or ethyl acetate. It may be added in the form of a mixture with an aqueous gelatin solution. Further, it may be added in the form of a emulsified dispersion of an organic solvent-soluble polymer, as described in JP-A 4-140739. The pAg at the time of selenium sensitization is preferably 6.0 to 10.0, and more preferably 6.5 to 9.5. The pH is preferably 4.0 to 9.0, and more preferably 4.0 to 6.5; and the temperature is preferably 40 to 90° C. and more preferably 45 to 85° C. The selenium sensitization may be performed in combination with sulfur sensitization, gold sensitization, or both of them.

There can be employed sulfur sensitizers described in U.S. Pat. Nos. 1,574,944, 2,410,689, 2,278,947, 2,728,668, 3,501,313, and 3,656,955; West German Patent (OLS) 1,422,869; JP-A 55-45016, 56-24937, and 5-165135. Preferred exemplary examples thereof include thiourea derivatives such as 1,3-diphenyl thiourea, triethylthiourea and 1-ethyl-3(2-thiazolyl)thiourea; rhodanine derivatives; dithiacarbamates, polysulfide organic compounds; and sulfur single substance. The amount of the sulfur sensitizer to be added, depending on the kind of the compound, the kind of a silver halide emulsion and chemical ripening conditions, is preferably $1\times10^{-9}$ to $10^{-4}$ moles, and more preferably $1\times10^{-8}$ to $1\times0^{-5}$ mole per mol of silver.

Further, chemical sensitizers to be used in combination include noble metal salts such as platinum, palladium and rhodium, as described in U.S. Pat. Nos.2,448,060, 2,566,245 and 2,566,263. The chemical sensitization may be carried out in the presence of thiocyanates (e.g., ammonium thiocyanate, potassium thiocyanate) or tetra-substituted thioureas (e.g., tetramethyl thiourea), which are a silver halide solvent.

Silver halide grains used in this invention may be subjected to spectral sensitization with methine dyes or others. Usable dyes are any one which causes electron transfer, including cyanine dyes, merocyanine dyes, complex cyanine dyes, complex merocyanine dyes, holopolar cyanine dyes, hemi-cyanine dyes, styryl dyes and hemi-oxonol dyes. Exemplary examples there of are described in U.S. Pat. No. 4,617,257; JP-A Nos. 59-180550 and 60140335; RE17029 (1978) pages 12–13. A dye which has itself no spectral sensitization function, or a compound which substantially has no visible absorption but exhibits super-sensitization, may be incorporated into the emulsion, together with a sensitizing dye (as described in U.S. Pat. No. 3,615,641 and JP-A No. 63-23145).

The sensitizing dye may be added to a silver halide emulsion before, during or after chemical ripening. Alternatively, it may be added before or after the nucleation stage of silver halide grains, as described in U.S. Pat. Nos. 4,183,756 and 4,225,666. The amount thereof is generally $10^{-8}$ to $10^{-2}$ mol/mol Ag. The sensitizing dye may be added during crystal growth, before chemical sensitization or simultaneously with a chemical sensitizer. It may be added after at 50% of chemical sensitization nuclei has been formed.

At least 70% (more preferably at least 80%) of the grain surface is preferably covered with a sensitizing dye. The covering factor of the sensitizing dye can be determined from the saturated adsorption amount and the adsorbing amount obtained from a conventional adsorption isotherm. For example, silver halide emulsions are prepared varying the addition amount of a sensitizing dye. Then, absorption spectrum of the supernatant obtained by centrifugal separation of each emulsion is measured, in which the absorption spectrum abruptly increases at an adding amount. This point is employed as the saturated adsorption amount. The covering factor of the sensitizing dye depends on the kind of the dye. In cases where a sensitizing dye is singly used, the saturated adsorption amount can be determined from its adsorption isotherm and thereby the covering factor can be determined. In cases where sensitizing dyes are used in combination, the saturated adsorption amount is generally lowered, relative to the single use. Accordingly, the covering factor must be determined from the substantial saturated adsorption amount for the combination of used dyes.

The silver halide grains used in the invention may be a surface latent image type or internal latent image type, including internal latent image forming grains described in JP-A 9-222684. The crystal habit of silver halide grains may be cubic, octahedral, tetradecahedral or tabular crystals, or other crystals. The silver halide grains are not specifically limited, and those which are described in RD308119, page 993, section I-A to page 995, section II. There can be used silver halide emulsions which have been subjected to physical ripening, chemical ripening and spectral sensitization. Additives used in these stages are described in RD17643, page 23, section III to page 24, section VI-M; RD18716, pages 648–649; and RD308119, page 996, section III-A to page 1,000, section VI-M. Commonly known photographic additives described in RD17643, page 25, section VIII-A to page 27, section XIII; RD18716, pages 650–651; and RD308119, page 996, section V to page 1,012, section XXI-E can also be employed.

It was found that the silver halide emulsion according to this invention displayed superior effects when applied to a diffusion transfer type silver halide photographic material.

The diffusion transfer process photographic product of the invention includes a film unit, in which a photosensitive element is held to be superimposed on an image receiving element before, during and after exposure. Such a film unit is typically called an "integral" film unit in the photographic art. In a commercially available embodiment of such a type of films (e.g., SX-70 Film), the support of the photosensitive element is non-transparent, the support of the image receiving element is transparent, and the light reflection layer (on which images formed in the image receiving layer can be viewed) is formed by providing a processing composition containing a light-reflecting pigment (e.g., titanium dioxide) between the superimposed elements. As described in U.S. Pat. No. 3,647,347, a pH-sensitive optical filtering agent (preferably, a pH-sensitive phthaleine dye) is incorporated into the processing composition, after which the film unit is discharged immediately after applying the processing composition and completing processing under ambient light, as the photographer watches a transferred image being emerging.

On the other hand, a so-called "peel apart" type film is also known in the art, in which the image receiving element is separated from the photosensitive element after completion of exposure and processing.

This invention is concerned with the diffusion transfer processes which utilize a viscous processing composition.

In the preferred embodiments of this invention, the transfer image is a dye image resulting from the use of dye developers in the development of an exposed silver halide emulsion; accordingly, the invention will be described for convenience by reference to its utilization in dye developer color transfer processes.

U.S. Pat. No. 2,983,606 discloses the formation of diffusion transfer color images by the use of dye developers, i.e., a compound which is both a silver halide developing agent and a dye. A photosensitive element containing a dye developer and a silver halide emulsion is exposed and a viscous processing composition is distributed in a substantial layer between the exposed photosensitive element and a superposed image-receiving element. The processing composition I so applied and confined within and between the two sheet-like elements as not to contact ot wet outer surfaces of the superposed elements, thus providing a film unit or film packet whose external surfaces are dry. The viscous processing composition preferably is distributed from a single-use rupturable container; such pressure rupturable processing containers are well known and are frequently referred to "pods". The liquid processing composition, distributed intermediate the photosensitive element and the image-receiving element, permeates the emulsion to initiate development of the latent image contained therein. The dye developer is immobilized or precipitated in exposed areas as a consequence of the development of the latent image. In undeveloped and partially developed areas of the emulsion, the dye developer is unreacted and diffusible and thus provides an imagewise distribution of unoxidized dye developer, diffusible in the liquid processing composition, as a function of the point-to-point degree of exposure of the silver halide emulsion. At least part of this imagewise distribution of unoxidized dye developer is transferred, by imbibition, to a superposed image-receiving element, the transfer substantially excluding oxidized dye developer. The image receiving element receives a depthwise diffusion, from the developed emulsion, of unoxidized dye developer without appreciably disturbing the imagewise distribution thereof to provide a reversed or positive color image of the developed image.

Dye developers, as noted above, are compoundswhich contain, in the same molecule, both the chromophoric system of a dye and also a silver halide developing functional group. A preferred silver halide developing functional group is a hydroquinonyl group. Other suitable developing functional groups include ortho-dihydroxyphenyl and ortho- and para-amino substituted hydroxyphenyl groups. In general, the development functional group includes a benzenoid developing functional group, that is, an aromatic developing group which forms quinoid or quinone substances when oxidized.

The dye developers employed may be incorporated in the respective silver halide emulsion or, in the preferred embodiment, in a separate layer behind the respective silver halide emulsion applied by the use of a coating solution containing the respective dye developer in a concentration calculated to give the desired coverage of dye developer per unit area, in a film-forming natural, or synthetic polymer, e.g., gelatin, polyvinyl alcohol, and the like, adapted to be permeated by the diffusion transfer processing composition.

Examples of materials for use in the image-receiving element include partially hydrolyzed polyvinyl acetate; polyvinyl alcohol; gelatin and other materials of a similar nature. Preferred materials comprise polyvinyl alcohol or gelatin containing a dye mordant such as poly-4-vinylpyridine, as described in U.S. Pat. No. 3,148,061.

As described in the previously cited patents, the liquid processing composition referred to for effecting multicolor diffusion transfer processes comprises at least an aqueous solution of an alkaline material, e.g., sodium hydroxide, potassium hydroxide, and the like, and preferably processing a pH of more than 12, and more preferably includes a viscosity-increasing compound constituting a film-forming material of the type which, when the composition is spread and dried, forms a relatively firm and relatively stable film. The preferred film-forming materials disclosed comprise high molecular weight polymers such as polymeric, water-soluble ethers such as water-soluble, polymeric ethers which are inert to an alkaline solution such as, e.g., a hydroxyethyl cellulose or sodium carboxymethyl cellulose. Other fil-forming polymers whose ability to increase viscosity is substantially unaffected if left in alkaline solution for a long period of time are also capable of utilization. As stated, the film-forming polymer is preferably contained in the processing composition in such suitable quantities as to impart to the composition a viscosity of more than 100 cps. at a temperature of approximately 24° C. and preferably in the order of 100,000 cps to 200,000 cps. at that temperature.

With regard to the diffusion transfer photographic products of the invention are those which are described in JP-B Nos. 52-18024 and 54-11697, and JP-A 6-67363, 10-506728, 11-509649 and 6-83006 are adopted. Furthermore, various additives, layer arrangements and processing described in these patents are also applicable. The present invention is effective in either one of the foregoing diffusion transfer process silver halide photographic products, but the integral type is preferred.

Supports for the photographic material or dye-fixing material according to this invention include, in general, paper and synthetic polymer films. Exemplary examples thereof include polyethylene terephthalate (also denoted as PET), polyethylene naphthalate (also denoted as PEN), polycarbonate, polyvinyl chloride, polystyrene, polypropylene, polyimide, celluloses (e.g., cellulose triacetate), their films containing a pigment such as titanium oxide, synthetic paper such as polypropylene synthetic paper, mixed paper made of a synthetic resin pulp such as polyethylene and a natural pulp, Yankee paper, coated paper (e.g., cast-coated paper), metals, fabrics and glasses. These supports may be used alone or as a support laminated with synthetic resin such as polyethylene on one side or both sides. Further, supports described in JP-A 62-253159, pages 29–31 are also usable. The surface of the support may be coated with a binder together with an antistatic agent including a semiconductive metal oxide such as alumina sol or tin oxide, and carbon black.

Preferred supports used in the invention are polyethylene terephthalate (PET) and polyethylene naphthalate (PEN). The thickness thereof is preferably 50 to 100 μm, and more preferably 60 to 90 μm. The use of PEN is specifically preferred in terms of a thinner film.

The supports used in this invention can be prepared by various methods known in the art. The support of PEN, for example, can be prepared according to the following manner.

Exemplary Preparation of PEN Support

To 100 parts by weight of dimethyl 2,6-naphthalenedicarboxylate and 60 parts by weight of ethylene glycol was added 0.1 parts by weight of calcium acetate as a transesterification catalyst and ester interchange was carried out according to the conventional method. To the obtained product were added 0.05 parts by weight of antimony trioxide and 0.03 parts by weight of trimethyl phosphate. Subsequently, the mixture was gradually heated with evacuating, and polymerization was carried out at 290° C. and 0.05 mmHg to obtain polyethylene 2,6-naphthalate exhibiting 0.60 of an intrinsic viscosity.

The thus obtained resin pellets are dried under reduced pressure at 150° C. for 8 hrs., then melted at 300° C., extruded through a T-type die, closely brought into contact with a cooling drum maintained at 50° C. with applying static electricity, and cooled to prepare non-stretched film. Using a roll type longitudinally stretching machine, the film was longitudinally stretched by 3.3 time at a temperature of 350° C. Then, using a tenter type laterally stretching machine, the thus obtained uniaxially stretched film was laterally stretched to 50% of the total lateral stretch magnification in the first stretching zone at 145° C. and was further laterally stretched by 3.3 times in the second zone at 155° C. The stretched film was thermally treated at 100° C. for 2 sec., then thermally fixed at 200° C. for 5 sec in the first fixing zone and further thermally relaxed at 240° C. for 15 sec. The film was further subjected to thermal relaxation by 5% in the lateral direction at 160° C. and cooled to room temperature in 30 sec. to obtain polyethylene naphthalate film of a thickness of 85 μm. The film was wound up around a stainless steel core and was thermally treated at 110° C. for 48 hrs. to obtain a support.

EXAMPLES

The present invention will be described based on examples, but embodiments of the invention are not limited to these examples.

Example 1

Preparation of Seed Emulsion N-1

To 500 ml of an aqueous 2% gelatin solution maintained at 40° C. were added 250 ml of an aqueous 4N silver nitrate solution and 250 ml of an aqueous potassium bromide and potassium iodide solution (molar ratio of KBr:KI=98:2) by the double jet addition, according to the method described in JP-A 50-45437, over a period of 35 min., while the pAg and pH were maintained at 9.0 and 2.0, respectively. After the resulting emulsion was adjusted to a pH of 5.5 with an aqueous calcium carbonate solution, a 364 ml aqueous solution of 5% DEMOL N (available from Kao-Atlas Corp.) and 244 ml of an aqueous magnesium sulfate solution were added thereto. After being allowed to stand for sedimentation, supernatant liquid was decanted and 1400 ml distilled water was added and dispersed. A 36.4 ml aqueous 20% magnesium sulfate solution was added to cause coagulation; the supernatant was decanted and an aqueous solution containing 28 g ossein gelatin was added to make a total volume of 425 ml. After stirring at 40° C. for a period of 40 min., seed emulsion N-1 was obtained. Electron microscopic observation revealed that the seed emulsion was comprised of monodisperse seed grains having an average size of 0.093 μm.

Preparation of Fine Silver Iodide Grain Emulsion N-2

The To 5 liters of a 6.0 wt. % gelatin solution containing 0.06 mol of potassium iodide, an aqueous solution containing 7.06 mol of silver nitrate and an aqueous solution containing 7.06 mol of potassium iodide, 2 liters of each were added over a period of 10 min., while the pH was maintained at 2.0 using nitric acid and the temperature was maintained at 40° C. After completion of grain formation, the pH was adjusted to 6.0 using a sodium carbonate aqueous solution. The finished weight was 12.53 kg. Electron microscopic observation revealed that the resulting emulsion was comprised of fine silver iodide grains having an average diameter of 0.05 μm.

Preparation of Emulsion Em-1

Emulsion Em-1 was prepared using the following solutions.

| Solution Gr-1 | |
|---|---|
| Ossein gelatin | 161.1 g |
| 10 wt % surfactant (EO-1) methanol solution | 3.0 ml |
| Seed emulsion N-1 | 97.7 ml |
| Distilled water to make | 4.2 lit. |
| EO-1: $HO(CH_2CH_2O)m(CH(CH_3)CH_2O)_{19.8}(CH_2CH_2O)nH$ (m + n = 9.77) | |
| **Solution B-1** | |
| Silver nitrate | 3560.9 g |
| Distilled water to make | 5.988 lit. |

-continued

| Solution B-2 | |
|---|---|
| Potassium bromide | 2857.2 g |
| Potassium iodide | 81.34 g |
| Distilled water to make | 7.0 lit. |

To solution Gr-1 with stirring at 70° C., solutions B-1 and B-2 were added by the double jet addition at a flow rate so that nucleus grains were not formed, while the pAg was maintained at 7.3 with an aqueous 1.75N potassium bromide solution and the pH was maintained at 4.0 with an aqueous acetic acid solution. After adding solution B-1, an aqueous 3.5N potassium bromide solution was added to adjust the pAg to 9.1 and after stirring further for 2 min, the emulsion was desalted according to the method described in JP-A 5-72658. Thereafter, gelatin was added and dispersed, and the pH and pAg at 40° C. were adjusted to 5.80 and 8.06, respectively. The thus prepared emulsion, the average silver iodide content of which was 2 mol %, was denoted as Em-1. From electron micrographs of the resulting emulsion, it was proved that the emulsion was comprised of cubic silver halide grains having an average edge length of 0.42 μm, exhibiting a variation coefficient of an edge length of 14%.

Preparation of Emulsion Em-2

Emulsion Em-2 was prepared in the same manner as in Em-1, except that the pAg was maintained at 7.7 during grain growth. The resulting emulsion was comprised of cubic-formed, tetradecahedral-like grains having an average silver iodide content of 2 mol % and an average edge length of 0.42 μm, exhibiting a variation coefficient of an edge length of 17%.

Preparation of Emulsion Em-3

To solution Gr-1 with stirring at 70° C., solution B-1, solution B-3 and silver iodide fine grain emulsion N-2 were added at a flow rate so that nucleus grains were not formed, while the pAg was maintained at 7.3 with an aqueous 1.75N potassium bromide solution and the pH was maintained at 4.0 with an aqueous acetic acid solution. During the addition, the flow rate was so controlled that a molar ratio of bromide ions supplied from the solution B-3 to iodide ions supplied from the emulsion N-2 was kept to be 98:2. After adding solution B-1, an aqueous 3.5N potassium bromide solution was added to adjust the pAg to 9.1 and after stirring further for 2 min, the emulsion was desalted in a manner similar to Em-1. Thereafter, gelatin was added and dispersed, and the pH and pAg at 40° C. were adjusted to 5.80 and 8.06, respectively. The thus prepared emulsion was denoted as Em-3, the average silver iodide content of which was 2 mol %. From electron micrographs of the resulting emulsion, it was proved that the emulsion was comprised of cubic silver halide grains having an average edge length of 0.42 μm, exhibiting a variation coefficient of an edge length of 14%.

| Solution B-3 | |
|---|---|
| Potassium bromide | 2915.5 g |
| Distilled water to make | 7.0 lit. |

According to the method afore-mentioned, the thus prepared emulsion each were measured with respect to the (100) face proportion of the emulsion grains and a variation coefficient of the (100) face proportion among the grains. Results thereof are shown in Table 1.

TABLE 1

| Emulsion | Grain Size (μm) | (100) Proportion*1 | Variation Coefficient of (100) Proportion | (100) Grain Proportion (%)*2 |
|---|---|---|---|---|
| Em-1 (Inv.) | 0.42 | 0.77 | 15.2 | 72 |
| Em-2 (Comp.) | 0.42 | 0.61 | 24.2 | 68 |
| Em-3 (Inv.) | 0.42 | 0.74 | 12.3 | 76 |

*1Average value

*2Proportion of regular crystal grains exhibiting a proportion of a (100) face per grain of at least 50%, based on the total grain projected area;

To each of the emulsions Em-1, Em-2 and Em-3 were added sensitizing dyes (S-1 and S-2), potassium thiocyanate, chloroauric acid, sodium thiosulfate and triphenylphosphine selenide and chemical sensitization was conducted so as to give the optimum speed-granularity relationship.

S-1

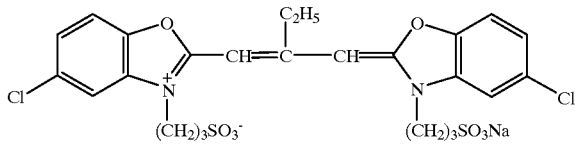

S-2

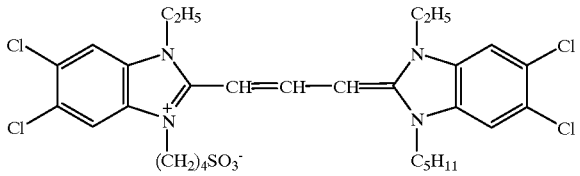

Diffusion transfer process photographic material samples 101 to 103 were prepared in accordance with Example of U.S. Pat. No. 3,776,726, provided that a green-sensitive silver iodobromide emulsion used in the 5th layer was replaced by each of emulsions Em-1, Em-2 and Em-3.

The thus prepared samples were each exposed through an optical wedge; and the exposed samples were allowed to pass through between paired pressure rollers so that a container having an aqueous processing composition was ruptured and its contents were distributed in a uniform layer between the photosensitive element and the image-receiving layer. Such image formation was substantially completed within one to three minutes, provided that this processing procedure was conducted under an atmosphere of 23° C. Processed samples were evaluated with respect to the minimum density (denoted as Dmin), sensitivity (denoted as S) and the maximum density (denoted as Dmax) of the magenta-component image density.

Separately, exposed samples were similarly processed under an atmosphere of 10° C. or 35° C. and the sensitivity of the magenta-component image density was determined to evaluate the processing temperature dependence.

Results are shown in Table 2. Sensitivity at a processing temperature of 23° C. was represented by a relative value, based on the sensitivity of Sample 101 being 100. Sensitivity at a processing temperature of 10° C. or 35° C. was also represented by a relative value, based on the sensitivity of Sample 101 at a processing temperature of 23° C. being 100; and the difference ($\Delta_1$) in sensitivity between 5° C. and 23° C., the difference ($\Delta_2$) in sensitivity between 10° C. and 23°

C. and the difference ($\Delta_3$) in sensitivity between 35° C. and 23° C. were determined for each sample.

TABLE 2

| | | 23° C. | | | 5° C. | 10° C. | 35° C. |
|---|---|---|---|---|---|---|---|
| Sample | Emulsion | Dmin | S | Dmax | $\Delta S_1$ | $\Delta S_2$ | $\Delta S_3$ |
| 101 | Em-1 (Inv.) | 0.13 | 100 | 2.23 | −24 | −17 | +5 |
| 102 | Em-2 (Comp.) | 0.18 | 95 | 2.01 | −41 | −33 | +25 |
| 103 | Em-3 (Inv.) | 0.13 | 101 | 2.20 | −21 | −15 | +8 |

As is apparent from Table 2, it was proved that a diffusion transfer type silver halide photographic material exhibiting enhanced sensitivity, lowered Dmin without reducing Dmax and improved processing temperature dependence was obtained by the use of the silver halide emulsion according to this invention.

Example 2

Preparation of Emulsion Em-4

Emulsion Em-4 was prepared using the following solutions.

Solution Gr-1

The same composition as used in Examples 1

| | |
|---|---|
| Solution B-3 | |
| Potassium bromide | 2915.5 g |
| Distilled water to make | 7.0 lit. |
| Solution B-4 | |
| Silver nitrate | 3488.9 g |
| Distilled water to make | 5.867 lit. |
| Solution B-5 | |
| Silver iodide fine grain emulsion N-2 | 752.1 g |

To solution Gr-1 with stirring at 70° C., solutions B-3 and B-4 were added by the double jet addition at a flow rate so that nucleus grains were not formed, while the pAg was maintained at 7.3 with an aqueous 1.75N potassium bromide solution and the pH was maintained at 4.0 with an aqueous acetic acid solution. When 3.869 lit. of Solution B-4 was added, addition of Solutions B-3 and B-4 was interrupted and after stirring for 1 min., Solution B-5 was added at a constant flow rate for a period of 2 min. Then, after stirring for 1 min., Solution B-3 and B-4 were again added at a flow rate so that nucleus grains were not formed, while the pAg was maintained at 7.3 with an aqueous 1.75N potassium bromide solution and the pH was maintained at 4.0 with an aqueous acetic acid solution. After completing addition of Solution B-4, the pAg was adjusted to 9.1 with an aqueous 3.5N potassium bromide solution and after stirring further for 2 min, the emulsion was desalted in a manner similar to Em-1. Thereafter, gelatin was added and dispersed, and the pH and pAg at 40° C. were adjusted to 5.80 and 8.06, respectively. The thus prepared emulsion was denoted as Em-4.

From electron micrographs of the resulting emulsion, it was proved that the emulsion was comprised of cubic silver halide grains having an average edge length of 0.42 μm, exhibiting a variation coefficient of an edge length of 14% and having an average iodide content of 2 mol %. Further, from electron micrographs of an ultra-thin slice of the grain, the grains contained dislocation lines and 92% of the total grain projected area was accounted for by the grains having dislocation lines.

Preparation of Emulsion Em-5

Emulsion Em-5 was prepared in the same manner as in Em-4, except that the pAg was maintained at 7.7 during addition of Solutions B-3 and B-4. The resulting emulsion was comprised of cubic-formed grains having an average edge length of 0.42 μm, exhibiting a variation coefficient of an edge length of 17% and having an average iodide content of 2 mol %. The grains appeared to be closer to a tetradecahedral form than Em-4. Further, from electron micrographs of an ultra-thin slice of the grain, the grains contained dislocation lines.

Preparation of Emulsion Em-6

To solution Gr-1 with stirring at 70° C., Solutions B-3 and B-4 and silver iodide fine grain emulsion N-2 were added at a flow rate so that nucleus grains were not formed, while the pAg was maintained at 7.3 with an aqueous 1.75N potassium bromide solution and the pH was maintained at 4.0 with an aqueous acetic acid solution. During the addition, the flow rate was so controlled that a molar ratio of bromide ions supplied from the solution B-3 to iodide ions supplied from the emulsion N-2 was kept to be 98:2. When 3.869 lit. of Solution B-4 was added, addition of Solutions B-3, B-4 and N-2 was interrupted and after stirring for 1 min., Solution B-5 was added at a constant flow rate for a period of 2 min. Then, after stirring for 1 min., Solution B-3, B-4 and N-2 were again added at a flow rate so that nucleus grains were not formed, while the pAg was maintained at 7.3 with an aqueous 1.75N potassium bromide solution and the pH was maintained at 4.0 with an aqueous acetic acid solution. After completing addition of Solution B-4, the pAg was adjusted to 9.1 with an aqueous 3.5N potassium bromide solution and after stirring further for 2 min, the emulsion was desalted in a manner similar to Em-1. Thereafter, gelatin was added and dispersed, and the pH and pAg at 40° C. were adjusted to 5.80 and 8.06, respectively. The thus prepared emulsion was denoted as Em-6. From electron micrographs of the resulting emulsion, it was proved that the emulsion was comprised of cubic silver halide grains having an average edge length of 0.42 μm, exhibiting a variation coefficient of an edge length of 14% and having an average iodide content of 2 mol %. Further, from electron micrographs of an ultra-thin slice of the grain, the grains contained dislocation lines.

According to the method afore-mentioned, the thus prepared emulsion each were measured with respect to a proportion of (100) face of the emulsion grains, a variation coefficient of the (100) face proportion among the grains and the high iodide phase within the grain. Further, the internal high iodide phase was also determined. Results thereof are shown in Tables 3A and 3B.

TABLE 3A

| Emulsion | Grain Size (μm) | (100) Proportion*1 | Variation Coefficient of (100) Proportion | (100) Grain Proportion (%)*2 |
|---|---|---|---|---|
| Em-4 (Inv.) | 0.42 | 0.67 | 13.2 | |
| Em-5 (Comp.) | 0.42 | 0.51 | 26.2 | |
| Em-6 (Inv.) | 0.42 | 0.59 | 15.9 | |

*1Average value

*2Proportion of regular crystal grains exhibiting a proportion of a (100) face per grain of at least 50%, based on the total grain projected area;

TABLE 3B

| | High Iodide Phase | | |
|---|---|---|---|
| Emul-sion | Position (%)*1 | Volume (%)*2 | I (mol %) |
| Em-4 | 7-13 | 13 | 15 |
| Em-5 | 7-13 | 13 | 15 |
| Em-6 | 7-13 | 13 | 15 |

*1Depth from (100) face, based on the length between the grain center and the (100) face; and
*2Percentage, based on grain volume.

Using emulsions Em-4, Em-5 and Em-6, diffusion transfer process photographic material samples 104 through 106 were prepared and evaluated in a manner similar to Example 1.

Results are shown in Table 4. Sensitivity at a processing temperature of 23° C. was represented by a relative value, based on the sensitivity of Sample 101 of Example 1 being 100. Sensitivity at a processing temperature of 10° C. or 35° C. was also represented by a relative value, based on the sensitivity of Sample 101 at a processing temperature of 23° C. being 100; and the difference ($\Delta_1$) in sensitivity between 5° C. and 23° C., the difference ($\Delta_2$) in sensitivity between 10° C. and 23° C. and the difference ($\Delta_3$) in sensitivity between 35° C. and 23° C. were determined for each sample.

TABLE 4

| | | 23° C. | | | 5° C. | 10° C. | 35° C. |
|---|---|---|---|---|---|---|---|
| Sample | Emulsion | Dmin | S | Dmax | $\Delta S_1$ | $\Delta S_2$ | $\Delta S_3$ |
| 104 | Em-4 (Inv.) | 0.14 | 141 | 2.20 | −20 | −15 | +7 |
| 105 | Em-5 (Comp.) | 0.18 | 120 | 1.98 | −36 | −30 | +21 |
| 106 | Em-6 (Inv.) | 0.13 | 134 | 2.22 | −18 | −14 | +6 |

As is apparent from Table 4, it was proved that a diffusion transfer type silver halide photographic material exhibiting enhanced sensitivity, lowered Dmin without reducing Dmax and improved processing temperature dependence was obtained by the use of the silver halide emulsion according to this invention, in which dislocation lines were introduced into the emulsion grains.

Example 3

Preparation of Emulsion Em-7

Emulsion Em-7 was prepared using the following solutions.

| | |
|---|---|
| Solution Gr-1 | |
| Ossein gelatin | 161.1 g |
| 10 wt % surfactant (EO-1) methanol solution | 3.0 ml |
| Seed emulsion N-1 | 97.7 ml |
| Distilled water to make | 4.2 lit. |
| Solution C-1 | |
| Silver nitrate | 3560.9 g |
| Distilled water to make | 5.988 lit. |

-continued

| | |
|---|---|
| Solution C-2 | |
| Potassium bromide | 2798.9 g |
| Potassium iodide | 162.7 g |
| Distilled water to | 7.0 lit. |

To solution Gr-1 with stirring at 70° C., Solutions C-1 and C-2 were added by the double jet addition at a flow rate so that nucleus grains were not formed, while the pAg was maintained at 7.3 with an aqueous 1.75N potassium bromide solution and the pH was maintained at 4.0 with an aqueous acetic acid solution. When 3.869 lit. of Solution C-1 was added, the pAg was adjusted to 7.6 with an aqueous 1.75N potassium bromide solution and then Solution C-1 and C-2 were again added at a flow rate so that nucleus grains were not formed, while the pAg was maintained at 7.3 with an aqueous 1.75N potassium bromide solution and the pH was maintained at 4.0 with an aqueous acetic acid solution. After completing addition of Solution B-4, the pAg was adjusted to 9.1 with an aqueous 3.5N potassium bromide solution and after stirring further for 2 min, the emulsion was desalted in a manner described in JP-A 5-72658. Thereafter, gelatin was added and dispersed, and the pH and pAg were adjusted to 5.80 and 8.06 at 40° C., respectively. The thus prepared emulsion was denoted as Em-7. From electron micrographs of the resulting emulsion, it was proved that the emulsion was comprised of cubic-formed, tetradecahedral-like silver halide grains having an average edge length of 0.42 μm, exhibiting a variation coefficient of an edge length of 13% and having an average iodide content of 4 mol %; and about 70% of the total grain projected area was accounted for by grains having a (100) face proportion of 50% or more and a variation coefficient of the (100) face proportion among grains of 33%.

Preparation of Emulsion Em-8

Emulsion Em-8 was prepared in the same manner as in Em-7, except that the pAg was maintained at 7.3 at the time of starting addition of Solution C-1 to completion of the addition of C-1. From electron micrographs of the resulting emulsion, it was proved that the emulsion was comprised of cubic silver halide grains having an average edge length of 0.42 μm, exhibiting a variation coefficient of an edge length of 9% and having an average iodide content of 4 mol %; and about 93% of the total grain projected area was accounted for by grains having a (100) face proportion of 50% or more and a variation coefficient of the (100) face proportion among grains of 13%.

Preparation of Emulsion Em-9

To solution Gr-1 with stirring at 70° C., Solutions C-1 and C-2 were added by the double jet addition. When 2.961 lit. of Solution C-1 was added (i.e., at the time of 50% of total silver to be used for grain formation having been consumed), addition of Solution C-3 was stopped and instead, Solution C-4 was added. When 4.426 lit. of Solution C-1 was added (i.e., at the time of 75% of total silver to be used for grain formation having been consumed), addition of Solution C-4 was stopped and addition of Solution C-3 was again started. Solution C-1 and C-3 were again added at a flow rate so that nucleus grains were not formed, while the pAg was maintained at 7.3 with an aqueous 1.75N potassium bromide solution and the pH was maintained at 4.0 with an aqueous acetic acid solution. After completing addition of Solution C-1, the pAg was adjusted to 9.1 with an aqueous 3.5N potassium bromide solution and after stirring further for 2 min, the emulsion was desalted in a manner described in JP-A 5-72658. Thereafter, gelatin was added and dispersed, and the pH and pAg were adjusted to 5.80 and 8.06 at 40° C., respectively. The thus prepared emulsion was denoted as Em-9.

| Solution C-3 | |
|---|---|
| Potassium bromide | 2915.5 g |
| Distilled water to make | 7.0 lit. |
| Solution C-4 | |
| Potassium bromide | 2624.0 g |
| Potassium iodide | 406.7 g |
| Distilled water to make | 7.0 lit. |

From electron micrographs of the resulting emulsion, it was proved that the emulsion Em-9 was comprised of cubic-formed (rather close to tetradecahedral-formed) silver halide grains having an average edge length of 0.42 μm, exhibiting a variation coefficient of an edge length of 17% and having an average iodide content of 2.5 mol %; and about 70% of the total grain projected area was accounted for by grains having a (100) face proportion of 50% or more and exhibiting a variation coefficient of the (100) face proportion among grains of 33%. Further, the grains had a silver halide phase containing 10 mol % iodide and accounting for 25% of the grain volume in the region of 5 to 75%, based on silver to be used for grain growth, from the grain center.

Preparation of Emulsion Em-10

To solution Gr-1 with stirring at 70° C., Solutions C-1 and C-5 were added by the double jet addition. When 2.961 lit. of Solution C-1 was added (i.e., at the time of 50% of total silver to be used for grain formation having been consumed), addition of Solution C-5 was stopped and instead, Solution C-6 was added. When 3.528 lit. of Solution C-1 was added (i.e., at the time of 60% of total silver to be used for grain formation having been consumed), addition of Solution C-6 was stopped and addition of Solution C-5 was again started. Solution C-1 and C-5 were again added at a flow rate so that nucleus grains were not formed, while the pAg was maintained at 7.3 with an aqueous 1.75N potassium bromide solution and the pH was maintained at 4.0 with an aqueous acetic acid solution. After completing addition of Solution C-1, the pAg was adjusted to 9.1 with an aqueous 3.5N potassium bromide solution and after stirring further for 2 min, the emulsion was desalted in a manner described in JP-A 5-72658. Thereafter, gelatin was added and dispersed, and the pH and pAg were adjusted to 5.80 and 8.06 at 40° C., respectively. The thus prepared emulsion was denoted as Em-10.

| Solution C-5 | |
|---|---|
| Potassium bromide | 2857.2 g |
| Potassium iodide | 81.3 g |
| Distilled water to make | 7.0 lit. |
| Solution C-6 | |
| Potassium bromide | 2755.1 g |
| Potassium iodide | 223.7 g |
| Distilled water to make | 7.0 lit. |

From electron micrographs of the resulting emulsion, it was proved that the emulsion Em-10 was comprised of cubic-formed silver halide grains having an average edge length of 0.42 μm, exhibiting a variation coefficient of an edge length of 12% and having an average iodide content of 2.5 mol %; and about 90% of the total grain projected area was accounted for by grains having a (100) face proportion of 50% or more and exhibiting a variation coefficient of the (100) face proportion among grains of 18%. Further, the grains had a silver halide phase containing 5.5 mol % iodide and accounting for 10% of the grain volume in the region of 50 to 60%, based on silver to be used for grain growth, from the grain center.

Preparation of Emulsion Em-11

To solution Gr-1 with stirring at 70° C., Solutions C-5 and C-7 were added by the double jet addition. When 3.196 lit. of Solution C-7 was added (i.e., at the time of 55% of total silver to be used for grain formation having been consumed), addition of Solutions (C-5) and (C-7) was stopped and after stirring for 1 min., Solution C-8 was added at a constant flow rate for 2 min. After stirring for 15 min., addition of Solutions C-5 and C-7 was again started. Solutions C-5 and C-7 were again added at a flow rate so that nucleus grains were not formed, while the pAg was maintained at 7.3 with an aqueous 1.75N potassium bromide solution and the pH was maintained at 4.0 with an aqueous acetic acid solution. After completing addition of Solution C-7, the pAg was adjusted to 9.1 with an aqueous 3.5N potassium bromide solution and after stirring further for 2 min, the emulsion was desalted in a manner described in JP-A 5-72658. Thereafter, gelatin was added and dispersed, and the pH and pAg were adjusted to 5.80 and 8.06 at 40° C., respectively. The thus prepared emulsion was denoted as Em-11.

| Solution C-7 | |
|---|---|
| Silver nitrate | 3524.9 g |
| Distilled water to make | 5.928 lit. |
| Solution C-8 | |
| Silver iodide fine grain emulsion N-2 | 376.1 g |

From electron micrographs of the resulting emulsion, it was proved that the emulsion Em-11 was comprised of cubic-formed silver halide grains having an average edge length of 0.42 μm, exhibiting a variation coefficient of an edge length of 9% and having an average iodide content of 3.0 mol %; and about 94% of the total grain projected area was accounted for by grains having a (100) face proportion of 50% or more and exhibiting a variation coefficient of the (100) face proportion among grains of 14%. Further, the grains had a silver halide phase containing 15 mol % iodide and accounting for 7% of the grain volume in the region of 55 to 62%, based on silver to be used for grain growth, from the grain center.

Preparation of Emulsion Em-12

To solution Gr-1 with stirring at 70° C., Solutions.C-5 and C-9 were added by the double jet addition. When 3.196 lit. of Solution C-9 was added (i.e., at the time of 55% of total silver to be used for grain formation having been consumed), addition of Solutions (C-5) and (C-9) was stopped and after stirring for 1 min., Solution C-10 was added at a constant flow rate for 2 min. After stirring for 15 min., addition of Solutions C-5 and C-9 was again started, in which the flow rate was 1/2 of that of Em-11. Solutions C-5 and C-9 were again added at a flow rate so that nucleus grains were not formed, while the pAg was maintained at 7.2 with an aqueous 1.75N potassium bromide solution and the pH was maintained at 4.0 with an aqueous acetic acid solution. After completing addition of Solution C-7, the pAg was adjusted to 9.1 with an aqueous 3.5N potassium bromide solution and after stirring further for 2 min, the emulsion was desalted in a manner described in JP-A 5-72658. Thereafter, gelatin was added and dispersed, and the pH and pAg were adjusted to 5.80 and 8.06 at 40° C., respectively. The thus prepared emulsion was denoted as Em-12.

| | |
|---|---|
| Solution C-9 | |
| Silver nitrate | 3506.9 g |
| Distilled water to make | 5.987 lit. |
| Solution C-10 | |
| Silver iodide fine grain emulsion N-2 | 564.2 g |

From electron micrographs of the resulting emulsion, it was proved that the emulsion Em-12 was comprised of cubic-formed silver halide grains having an average edge length of 0.42 μm, exhibiting a variation coefficient of an edge length of 12% and having an average iodide content of 3.5 mol %; and about 90% of the total grain projected area was accounted for by grains having a (100) face proportion of 50% or more and exhibiting a variation coefficient of the (100) face proportion among grains of 19%. Further, the grains had a silver halide phase containing 12 mol % iodide and accounting for 12% of the grain volume in the region of 55 to 67%, based on silver to be used for grain growth, from the grain center.

Preparation of Em-13

To solution Gr-1 with stirring at 70° C., Solutions C-5 and C-9 were added by the double jet addition at a flow rate so that nucleus grains were not formed, while the pAg was maintained at 7.3 with an aqueous 1.75N potassium bromide solution and the pH was maintained at 4.0 with an aqueous acetic acid solution. When 3.196 lit. of Solution C-9 was added (i.e., at the time of 55% of total silver to be used for grain formation having been consumed), addition of Solutions (C-5) and (C-9) was stopped and after stirring for 1 min., Solution C-10 was added at a constant flow rate for 2 min. After stirring for 15 min., addition of Solutions C-5 and C-9 was again started, in which the flow rate was 1/2 of that of Em-11. Solutions C-5 and C-9 were again added at a flow rate so that nucleus grains were not formed, while the pAg was maintained at 7.2 with an aqueous 1.75N potassium bromide solution and the pH was maintained at 4.0 with an aqueous acetic acid solution. After completing addition of Solution C-9, the pAg was adjusted to 9.1 with an aqueous 3.5N potassium bromide solution and after stirring further for 2 min, the emulsion was desalted in a manner described in JP-A 5-72658. Thereafter, gelatin was added and dispersed, and the pH and pAg were adjusted to 5.80 and 8.06 at 40° C., respectively. The thus prepared emulsion was denoted as Em-13.

From electron micrographs of the resulting emulsion, it was proved that the emulsion Em-13 was comprised of cubic-formed silver halide grains having an average edge length of 0.42 μm, exhibiting a variation coefficient of an edge length of 15% and having an average iodide content of 3.5 mol %; and about 88% of the total grain projected area was accounted for by grains having a (100) face proportion of 50% or more and exhibiting a variation coefficient of the (100) face proportion among grains of 25%. Further, the grains had a silver halide phase containing 12 mol % iodide and accounting for 12% of the grain volume in the region of 55 to 67%, based on silver to be used for grain growth, from the grain center.

Preparation of Em-14

To solution Gr-1 with stirring at 70° C., Solutions C-5 and C-9 were added by the double jet addition. When 1.448 lit. of Solution C-9 was added (i.e., at the time of 25% of total silver to be used for grain formation having been consumed), addition of Solutions (C-5) and (C-9) was stopped and after stirring for 1 min., Solution C-10 was added at a constant flow rate for 2 min. After stirring for 15 min., addition of Solutions C-5 and C-9 was again started, in which the flow rate was 1/2 of that of Em-11. Solutions C-5 and C-9 were again added at a flow rate so that nucleus grains were not formed, while the pAg was maintained at 7.3 with an aqueous 1.75N potassium bromide solution and the pH was maintained at 4.0 with an aqueous acetic acid solution. After completing addition of Solution C-9, the pAg was adjusted to 9.1 with an aqueous 3.5N potassium bromide solution and after stirring further for 2 min, the emulsion was desalted in a manner described in JP-A 5-72658. Thereafter, gelatin was added and dispersed, and the pH and pAg were adjusted to 5.80 and 8.06 at 400 ° C., respectively. The thus prepared emulsion was denoted as Em-14.

From electron micrographs of the resulting emulsion, it was proved that the emulsion Em-14 was comprised of cubic-formed silver halide grains having an average edge length of 0.42 μm, exhibiting a variation coefficient of an edge length of 15% and having an average iodide content of 3.5 mol %; and about 90% of the total grain projected area was accounted for by grains having a (100) face proportion of 50% or more and exhibiting a variation coefficient of the (100) face proportion among grains of 19%. Further, the grains had a silver halide phase containing 15 mol % iodide and accounting for 10% of the grain volume in the region of 25 to 35%, based on silver to be used for grain growth, from the grain center. Preparation of Em-15

To solution Gr-1 with stirring at 70° C., Solutions C-5 and C-9 were added by the double jet addition. When 5.080 lit. of Solution C-9 was added (i.e., at the time of 85% of total silver to be used for grain formation having been consumed), addition of Solutions (C-5) and (C-9) was stopped and after stirring for 1 min., Solution C-10 was added at a constant flow rate for 2 min. After stirring for 15 min., addition of Solutions C-5 and C-9 was again started. Solutions C-5 and C-9 were again added at a flow rate so that nucleus grains were not formed, while the pAg was maintained at 7.3 with an aqueous 1.75N potassium bromide solution and the pH was maintained at 4.0 with an aqueous acetic acid solution. After completing addition of Solution C-9, the pAg was adjusted to 9.1 with an aqueous 3.5N potassium bromide solution and after stirring further for 2 min, the emulsion was desalted in a manner described in JP-A 5-72658. Thereafter, gelatin was added and dispersed, and the pH and pAg were adjusted to 5.80 and 8.06 at 40° C., respectively. The thus prepared emulsion was denoted as Em-15.

From electron micrographs of the resulting emulsion, it was proved that the emulsion Em-15 was comprised of cubic-formed silver halide grains having an average edge length of 0.42 μm, exhibiting a variation coefficient of an edge length of 17% and having an average iodide content of 3.5 mol %; and about 85% of the total grain projected area was accounted for by grains having a (100) face proportion of 50% or more and exhibiting a variation coefficient of the (100) face proportion among grains of 27%. Further, the grains had a silver halide phase containing 15 mol % iodide and accounting for 10% of the grain volume in the region of 85 to 95%, based on silver to be used for grain growth, from the grain center.

Preparation of Em-16

To solution Gr-1 with stirring at 70° C., Solutions C-7 and C-11 were added by the double jet addition. When 3.196 lit. of Solution C-7 was added (i.e., at the time of 55% of total silver to be used for grain formation having been consumed), addition of Solutions (C-7) and (C-11) was stopped and after stirring for 1 min., Solution C-8 was added at a constant flow rate for 2 min. After stirring for 15 min., addition of Solutions C-7 and C-11 was again started. Solutions C-7 and C-11 were again added at a flow rate so that nucleus grain s were not formed, while the pAg was maintained at 7.3 with an aqueous 1.75N potassium bromide solution and the pH was maintained at 4.0 with an aqueous acetic acid solution. After completing addition of Solution C-7, the pAg was adjusted to 9.1 with an aqueous 3.5N potassium bromide solution and after stirring further for 2 min, the emulsion was desalted in a manner described in JP-A 5-72658. Thereafter, gelatin was added and dispersed, and the pH and pAg were adjusted to 5.80 and 8.06 at 40° C., respectively. The thus prepared emulsion was denoted as Em-16.

| Solution C-11 | |
|---|---|
| Potassium bromide | 2755.1 g |
| Potassium iodide | 223.7 g |

From electron micrographs of the resulting emulsion, it was proved that the emulsion Em-16 was comprised of cubic-formed silver halide grains having an average edge length of 0.42 μm, exhibiting a variation coefficient of an edge length of 13% and having an average iodide content of 6.5 mol %; and about 83% of the total grain projected area was accounted for by grains having a (100) face proportion of 50% or more and exhibiting a variation coefficient of the (100) face proportion among grains of 19%. Further, the grains had a silver halide phase containing 15 mol % iodide and accounting for 7% of the grain volume in the region of 55 to 62%, based on silver to be used for grain growth, from the grain center.

Using emulsions Em-7 through Em-16, diffusion transfer photographic material samples 107 through 116 were prepared and evaluated in a manner similar to Example 1.

Results are shown in Table 5. Sensitivity at a processing temperature of 23° C. was represented by a relative value, based on the sensitivity of Sample 101 of Example 1 being 100. Sensitivity at a processing temperature of 10° C. or 35° C. was also represented by a relative value, based on the sensitivity of Sample 101 at a processing temperature of 23° C. being 100; the difference ($\Delta_2$) in sensitivity between 10° C. and 23° C. and the difference ($\Delta_3$) in sensitivity between 35° C. and 23° C. were determined for each sample.

TABLE 5

| | | 23° C. | | | 10° C. | 35° C. |
|---|---|---|---|---|---|---|
| Sample | Emulsion | Dmin | S | Dmax | $\Delta S_2$ | $\Delta S_3$ |
| 107 | Em-7 (Comp.) | 0.17 | 100 | 1.86 | −31 | +23 |
| 108 | Em-8 (Inv.) | 0.14 | 104 | 2.19 | −13 | +5 |
| 109 | Em-9 (Comp.) | 0.19 | 118 | 1.91 | −28 | +20 |
| 110 | Em-10 (Inv.) | 0.14 | 106 | 2.20 | −12 | +6 |
| 111 | Em-11 (Inv.) | 0.13 | 135 | 2.16 | −8 | +5 |
| 112 | Em-12 (Inv.) | 0.13 | 146 | 2.23 | −10 | +6 |
| 113 | Em-13 (Inv.) | 0.14 | 133 | 2.21 | −14 | +8 |
| 114 | Em-14 (Inv.) | 0.13 | 112 | 2.22 | −14 | +10 |
| 115 | Em-15 (Comp.) | 0.18 | 95 | 1.93 | −27 | +18 |
| 116 | Em-16 (Inv.) | 0.15 | 117 | 2.10 | −12 | +7 |

As is apparent from Table 5, it was proved that a diffusion transfer type silver halide photographic material exhibiting enhanced sensitivity, lowered Dmin without reducing max and improved processing temperature dependence was obtained by the use of the silver halide emulsion according to this invention. Specifically, from the comparison of Samples 107 and 108, and of Samples 112 and 113, the less variation coefficient of a (100) face proportion among grains is, the better sensitivity, contrast and pressure resistance. From the comparison of Samples 303 and 307, the volume accounted for by a high iodide shell of 15% or less is shown to be preferred, specifically in pressure resistance. From the comparison of Samples 306 and 305, the volume of 8% or less is shown to exhibit markedly improved pressure resistance.

As is apparent from Sample 114, when the high iodide shell is localized more toward the interior position than the inventive emulsion grains, it is not preferred in terms of sensitivity and pressure resistance. Further from Sample 115 when the high iodide shell is localized at a position toward the exterior than the inventive emulsion grains, it is not preferred in terms of reduced contrast. From the comparison of Samples 111 and 116, the average iodide content of more than 5 mol % resulted in reduction in contrast, and it is proved that the average iodide content of not more than 5 mol % is preferred.

Example 4

Preparation of Em-17

To solution Gr-1 with stirring at 70° C., Solutions C-7 and C-5 were added by the double jet addition, while the pAg was maintained at 7.6 with an aqueous 1.75N potassium bromide solution and the pH was maintained at 4.0 with an aqueous acetic acid solution. When 3.196 lit. of Solution C-7 was added (i.e., at the time of 55% of total silver to be used for grain formation having been consumed), addition of Solutions (C-7) and (C-5) was stopped and after stirring for 1 min., Solution C-8 was added at a constant flow rate for 2 min. After stirring for 15 min., addition of Solutions C-7 and C-5 was again started. Solutions C-7 and C-11 were again added at a flow rate so that nucleus grains were not formed, while the pAg was maintained at 7.2 with an aqueous 1.75N potassium bromide solution and the pH was maintained at 4.0 with an aqueous acetic acid solution. After completing addition of Solution C-7, the pAg was adjusted to 9.1 with an aqueous 3.5N potassium bromide solution and after stirring further for 2 min, the emulsion was desalted in a manner described in JP-A 5-72658. Thereafter, gelatin was added and dispersed, and the pH and pAg were adjusted to 5.80 and 8.06 at 40° C., respectively. The thus prepared emulsion was denoted as Em-17. From electron micrographs of the resulting emulsion, it was proved that the emulsion Em-17 was comprised of cubic-formed silver halide grains having an average edge length of 0.42 μm, exhibiting a variation coefficient of an edge length of 11% and having an average iodide content of 3 mol %; and about 94% of the total grain projected area was accounted for by grains having a (100) face proportion of 50% or more and exhibiting a variation coefficient of the (100) face proportion among grains of 16%. Further, the grains had a silver halide phase containing 15 mol % iodide and accounting for 7% of the grain volume in the region of 55 to 62%, based on silver to be used for grain growth, from the grain center.

Preparation of Em-18

To solution Gr-1 with stirring at 70° C., Solutions C-7 and C-5 were added by the double jet addition, while the pAg was maintained at 7.2 with an aqueous 1.75N potassium bromide solution and the pH was maintained at 4.0 with an aqueous acetic acid solution. When 3.196 lit. of Solution C-7 was added (i.e., at the time of 55% of total silver to be used for grain formation having been consumed), addition of Solutions (C-7) and (C-5) was stopped and after stirring for 1 min., Solution C-8 was added at a constant flow rate for 2 min. After stirring for 15 min., addition of Solutions C-7 and C-5 was again started. Solutions C-7 and C-11 were added at a flow rate so that nucleus grains were not formed, while the pAg was maintained at 7.6 with an aqueous 1.75N potassium bromide solution and the pH was maintained at 4.0 with an aqueous acetic acid solution. When 4.45 lit. of Solution C-7 was added, addition of Solution C-5 was stopped; and when the pAg reached 7.3, the addition of Solution C-5 was started, while the pAg was maintained at 7.3 with an aqueous 1.75N potassium bromide solution and the pH was maintained at 4.0 with an aqueous acetic acid solution, until completion of the addition of Solution C-7. After completing addition of Solution C-7, the pAg was adjusted to 9.1 with an aqueous 3.5N potassium bromide solution and after stirring further for 2 min, the emulsion was desalted in a manner described in JP-A 5-72658. Thereafter, gelatin was added and dispersed, and the pH and pAg were adjusted to 5.80 and 8.06 at 40° C., respectively. The thus prepared emulsion was denoted as Em-18.

From electron micrographs of the resulting emulsion, it was proved that the emulsion Em-18 was comprised of cubic-formed silver halide grains having an average edge length of 0.42 μm, exhibiting a variation coefficient of an edge length of 14% and having an average iodide content of 3 mol %; and about 92% of the total grain projected area was accounted for by grains having a (100) face proportion of 50% or more and exhibiting a variation coefficient of the (100) face proportion among grains of 19%. Further, the grains had a silver halide phase containing 15 mol % iodide and accounting for 7% of the grain volume in the region of 55 to 62%, based on silver to be used for grain growth, from the grain center.

According to the method afore-mentioned, emulsions Em-11, Em-17 and Em-18 each were measure with respect to the high iodide containing phase and results thereof are shown in Table 6.

TABLE 6

| Emulsion | Proportion of grains having high iodide phase at position facing to (100) surface* | Proportion of grains having high iodide phase at position facing edge, corner, (111) surface and (110) surface* |
|---|---|---|
| Em-11 (Inv.) | 56 | 83 |
| Em-17 (Inv.) | 33 | 85 |
| Em-18 (Inv.) | 66 | 41 |

*Based on the total grain projected area.

Using emulsions Em-17 and Em-18, diffusion transfer photographic material samples 117 through 118 were prepared and evaluated in a manner similar to Example 1.

Results are shown in Table 7. Sensitivity at a processing temperature of 23° C. was represented by a relative value, based on the sensitivity of Sample 101 of Example 1 being 100. Sensitivity at a processing temperature of 10° C. or 35° C. was also represented by a relative value, based on the sensitivity of Sample 101 at a processing temperature of 23° C. being 100; and the difference ($\Delta_2$) in sensitivity between 10° C. and 23° C. and the difference ($\Delta_3$) in sensitivity between 35° C. and 23° C. were determined for each sample.

TABLE 7

| | | 23° C. | | | 10° C. | 35° C. |
|---|---|---|---|---|---|---|
| Sample | Emulsion | Dmin | S | Dmax | $\Delta S_2$ | $\Delta S_3$ |
| 111 | Em-11 (Inv.) | 0.13 | 135 | 2.16 | −8 | +5 |
| 117 | Em-17 (Inv.) | 0.12 | 137 | 2.30 | −14 | +11 |
| 118 | Em-18 (Inv.) | 0.15 | 130 | 2.13 | −6 | +3 |

As is apparent from Table 7, it was proved that the use of emulsion Em-17 led to a diffusion transfer photographic material specifically exhibiting superior Dmax and Dmin and the use of emulsion Em-18 led to a diffusion transfer photographic material specifically exhibiting superiority in processing temperature dependence. Thus, a diffusion transfer photographic material exhibiting enhanced sensitivity, lowered Dmin without reducing Dmax and improved processing temperature dependence can be achieved by the optimal selection and use of the silver halide emulsion according to this invention.

Example 5

Preparation of Emulsion Em-19

To solution Gr-1 with stirring at 70° C., Solutions C-7 and C-5 were added by the double jet addition, while the pAg was maintained at 7.2 with an aqueous 1.75N potassium bromide solution and the pH was maintained at 4.0 with an aqueous acetic acid solution. When 3.196 lit. of Solution C-7 was added (i.e., at the time of 55% of total silver to be used for grain formation having been consumed), addition of Solutions (C-7) and (C-5) was stopped and after stirring for 1 min., Solution C-8 was added at a constant flow rate for 2 min. After stirring for 1 min., addition of Solutions C-7 and C-5 was again started. Solutions C-7 and C-11 were added at a flow rate so that nucleus grains were not formed, while the pAg was maintained at 7.6 with an aqueous 1.75N potassium bromide solution and the pH was maintained at 4.0 with an aqueous acetic acid solution. When 4.45 lit. of Solution C-7 was added, addition of Solution C-5 was stopped; and when the pAg reached 7.3, the addition of Solution C-5 was started, while the pAg was maintained at 7.3 with an aqueous 1.75N potassium bromide solution and the pH was maintained at 4.0 with an aqueous acetic acid solution, until completion of the addition of Solution C-7. After completing addition of Solution C-7, the pAg was adjusted to 9.1 with an aqueous 3.5N potassium bromide solution and after stirring further for 2 min, the emulsion was desalted in a manner described in JP-A 5-72658. Thereafter, gelatin was added and dispersed, and the pH and pAg were adjusted to 5.80 and 8.06 at 40° C., respectively. The thus prepared emulsion was denoted as Em-19.

From electron micrographs of the resulting emulsion, it was proved that the emulsion Em-19 was comprised of cubic-formed silver halide grains having an average edge length of 0.42 μm, exhibiting a variation coefficient of an edge length of 14% and having an average iodide content of 3 mol %; and about 90% of the total grain projected area was accounted for by grains having a (100) face proportion of 50% or more and exhibiting a variation coefficient of the (100) face proportion among grains of 19%.

Preparation of Emulsion Em-20

To solution Gr-1 with stirring at 70° C., Solutions C-7 and C-5 were added by the double jet addition, while the pAg was maintained at 7.2 with an aqueous 1.75N potassium bromide solution and the pH was maintained at 4.0 with an aqueous acetic acid solution. When 3.196 lit. of Solution C-7 was added (i.e., at the time of 55% of total silver to be used for grain formation having been consumed), addition of Solutions (C-7) and (C-5) was stopped and after stirring for 1 min., Solution C-8 was added at a constant flow rate for 2 min. After stirring for 1 min., addition of Solutions C-7 and C-5 was again started. Solutions C-7 and C-11 were added at a flow rate so that nucleus grains were not formed, while the pAg was maintained at 7.2 with an aqueous 1.75N potassium bromide solution and the pH was maintained at 4.0 with an aqueous acetic acid solution. After completing addition of Solution C-7, the pAg was adjusted to 9.1 with an aqueous 3.5N potassium bromide solution and after stirring further for 2 min, the emulsion was desalted in a manner described in JP-A 5-72658. Thereafter, gelatin was added and dispersed, and the pH and pAg were adjusted to 5.80 and 8.06 at 40° C., respectively. The thus prepared emulsion was denoted as Em-20.

From electron micrographs of the resulting emulsion, it was proved that the emulsion Em-20 was comprised of cubic-formed silver halide grains having an average edge length of 0.42 μm, exhibiting a variation coefficient of an edge length of 11% and having an average iodide content of 3 mol %; and about 93% of the total grain projected area was accounted for by grains having a (100) face proportion of 50% or more and exhibiting a variation coefficient of the (100) face proportion among grains of 18%.

According to the method afore-mentioned, emulsions 11, Em-19 and Em-20 were measure with respect to the number of dislocation lines of a grain and their orientation. Results thereof are shown in Table 8.

TABLE 8

| Emulsion | Proportion-1 (%) * | Proportion-2 (%) ** | Proportion-3 (%) *** |
|---|---|---|---|
| Em-11 (Inv.) | 45 | 41 | 35 |
| Em-19 (Inv.) | 67 | 19 | 60 |
| Em-20 (Inv.) | 77 | 24 | 73 |

* Proportion of grains having 10 or more dislocation lines per grain, based on the total grain projected area.
** Proportion of grains having dislocation lines, at least 60% of which orient to corner, edge, (111) face or (110) face, based on the total grain projected area.
*** Proportion of grains having dislocation lines, at least 60% of which orient to (100) face, based on the total grain projected area.

Using emulsions Em-19 and Em-20, diffusion transfer photographic material samples 119 through 120 were prepared and evaluated in a manner similar to Example 1.

Results are shown in Table 9. Sensitivity at a processing temperature of 23° C. was represented by a relative value, based on.the sensitivity of Sample 101 of Example 1 being 100. Sensitivity at a processing temperature of 10° C. or 35° C. was also represented by a relative value, based on the sensitivity of Sample 101 at a processing temperature of 23° C. being 100; and the difference ($\Delta_2$) in sensitivity between 10° C. and 23° C. and the difference ($\Delta_3$) in sensitivity between 35° C. and 23° C. were determined for each sample.

TABLE 9

| | | 23° C. | | | 10° C. | 35° C. |
|---|---|---|---|---|---|---|
| Sample | Emulsion | Dmin | S | Dmax | $\Delta S_2$ | $\Delta S_3$ |
| 111 | Em-11 (Inv.) | 0.13 | 135 | 2.16 | −8 | +5 |
| 119 | Em-19 (Inv.) | 0.14 | 128 | 2.11 | −7 | +3 |
| 120 | Em-20 (Inv.) | 0.12 | 137 | 2.31 | −16 | +12 |

As is apparent from Table 7, it was proved that the use of emulsion Em-19 led to a diffusion transfer photographic material specifically exhibiting superiority in processing temperature dependence and the use of emulsion Em-20 led to a diffusion transfer photographic material specifically exhibiting superior Dmax and Dmin. Thus, a diffusion transfer photographic material exhibiting enhanced sensitivity, lowered Dmin without reducing Dmax and improved processing temperature dependence can be achieved by the optimal selection and use of the silver halide emulsion according to this invention.

Example 6

Emulsion 21 was prepared in a manner similar to emulsion Em-12 of example 3, except that iodide ion-releasing agent (exemplified Compound 58) was used in place of Solution C-10. From electron micrographs of the resulting emulsion, it was proved that the emulsion Em-21 was comprised of cubic-formed silver halide grains having an average edge length of 0.42 μm, exhibiting a variation coefficient of an edge length of 13% and having an average iodide content of 3.5 mol %; and about 90% of the total grain projected area was accounted for by grains having a (100) face proportion of 50% or more and exhibiting a variation coefficient of the (100) face proportion among grains of 20%. Further, the grains had a silver halide phase containing 14 mol % iodide and accounting for 10% of the grain volume in the region of 55 to 65%, based on silver to be used for grain growth, from the grain center.

Sample 21 was evaluated in a manner similar to Example 3. As a result, a diffusion transfer photographic material was obtained, exhibiting superior performance, which was the same level as Sample 12.

Example 7

Diffusion transfer photographic material sample 122 was prepared in the same manner as Sample 111 of Example 3, except that in chemical sensitization of emulsion Em-11, 40% of sodium thiosulfate was replaced by an equimolar amount of selenium sensitizer (corresponding to compound S-1 described in Examples of JP-A 9-96883).

Results are shown in Table 10. Sensitivity at a processing temperature of 23° C. was represented by a relative value, based on the sensitivity of Sample 101 of Example 1 being 100. Sensitivity at a processing temperature of 10° C. or 35° C. was also represented by a relative value, based on the sensitivity of Sample 101 at a processing temperature of 23° C. being 100; and the difference ($\Delta_1$) in sensitivity between 5° C. and 23° C., the difference ($\Delta_2$) in sensitivity between 10° C. and 23° C. and the difference ($\Delta_3$) in sensitivity between 35° C. and 23° C. were determined for each sample.

TABLE 10

| Sample | Emulsion | Selenium Sensitization | 23° C. | | | 10° C. | 35° C. |
|---|---|---|---|---|---|---|---|
| | | | Dmin | S | Dmax | $\Delta S_2$ | $\Delta S_3$ |
| 111 | Em-11 (Inv.) | No | 0.13 | 135 | 2.16 | −8 | +5 |
| 122 | Em-11 (Inv.) | Yes | 0.12 | 144 | 2.22 | −5 | +3 |

As is apparent from Table 10, it was proved that a diffusion transfer type silver halide photographic material exhibiting enhanced sensitivity, reduced Dmin without reducing Dmax and improved processing temperature dependence was obtained by the use of the silver halide emulsion according to this invention, which was subjected to selenium sensitization.

Example 8

Diffusion transfer photographic material sample 123 and 124 were prepared in the same manner as Sample 104 of Example 2, except that in spectral sensitization of emulsion Em-4, the ratio of coverage of the sensitizing dye on the silver halide grain surface was varied Results are shown in Table 11. Sensitivity at a processing temperature of 23° C. was represented by a relative value, based on the sensitivity of Sample 101 of Example 1 being 100. Sensitivity at a processing temperature of 10° C. or 35° C. was also represented by a relative value, based on the sensitivity of Sample 101 at a processing temperature of 23° C. being 100; and the difference ($\Delta_1$) in sensitivity between 5° C. and 23° C., the difference ($\Delta_2$) in sensitivity between 10° C. and 23° C. and the difference ($\Delta_3$) in sensitivity between 35° C. and 23° C. were determined for each sample.

TABLE 11

| Sample | Emulsion | Coverage of Dye | 23° C. Dmin | 23° C. S | 23° C. Dmax | 10° C. $\Delta S_2$ | 35° C. $\Delta S_3$ |
|---|---|---|---|---|---|---|---|
| 123 | Em-4 (Inv.) | 56% | 0.15 | 130 | 2.15 | −16 | +8 |
| 124 | Em-4 (Inv.) | 78% | 0.13 | 143 | 2.22 | −7 | +5 |

As is apparent from Table 11, it was proved that a diffusion transfer photographic material exhibiting enhanced sensitivity, lowered Dmin without reducing Dmax and improved processing temperature dependence was obtained by the use of the silver halide emulsion according to this invention, which was spectrally sensitized so that at least 70 of the grain surface was covered with a sensitizing dye.

Example 9

Emulsion Em-22 was prepared similarly to emulsion Em-11. From electron micrographs of the resulting emulsion, it was proved that the emulsion Em-22 was comprised of cubic-formed silver halide grains having an average edge length of 0.85 μm, exhibiting a variation coefficient of an edge length of 10% and having an average iodide content of 3.0 mol %; and about 91% of the total grain projected area was accounted for by grains having a (100) face proportion of 50% or more and exhibiting a variation coefficient of the (100) face proportion among grains of 14%.

Using emulsion Em-22, a diffusion transfer photographic material sample 22 was prepared and evaluated in the same manner as in Example 1. As a result, a diffusion transfer photographic material exhibiting enhanced sensitivity, lowered Dmin without reducing Dmax and improved processing temperature dependence was obtained.

Example 10

Similarly to Example 1, a diffusion transfer silver halide photographic material was prepared in accordance with Examples of JP-B 52-18024, provided that the green-sensitive silver iodobromide emulsion used in the 5th layer was replaced by emulsion Em-11 used in Example 3 (having an average edge length of 0.42 μm) and emulsion Em-11 used in Example 9 (having an average edge length of 0.85 μm), in a ratio of 30:70, based on silver. The thus prepared diffusion transfer photographic material was evaluated similarly to Example 1, so that a diffusion transfer photographic material exhibiting enhanced sensitivity, lowered Dmin without reducing Dmax and improved processing temperature dependence was obtained.

Example 11

Emulsion Em-11 used in Example 3 was varied in spectral sensitization by changing a sensitizing dye. Similarly to Example 1, a diffusion transfer silver halide photographic material was prepared in accordance with Examples of JP-B 52-18024, provided that the red-sensitive silver iodobromide emulsion used in the 2nd layer was replaced by the above-described emulsion Em-11. The thus prepared diffusion transfer photographic material was evaluated similarly to Example 1, so that a diffusion transfer photographic material exhibiting enhanced sensitivity, lowered Dmin without reducing Dmax and improved processing temperature dependence was obtained.

What is claimed is:

1. A diffusion transfer photographic product comprising a photosensitive element, an image receiving element and a container having a processing composition, wherein the photosensitive element comprises a support having thereon at least a silver halide emulsion layer containing a silver halide emulsion comprising silver halide grains and at least 50% of total grain projected area is accounted for by silver halide regular crystal grains containing 5 mol % or less chloride and 0.5 mol % or more iodide and exhibiting a proportion of a (100) face per grain of not less than 50%, a variation coefficient of the proportion of a (100) face among grains being not more than 20%.

2. The photographic product of claim 1, wherein said regular crystal grains each have an internal high iodide phase having an average iodide content of not less than 7 mol % and accounting for 0.1 to 15% of the grain volume; said high iodide phase being in the region at a depth of from 7 to 27% from the (100) face, based on the distance between the center of a grain and the (100) face.

3. The photographic product of claim 2, wherein said high iodide phase is at a position facing a (100) face of the grain.

4. The photographic product of claim 2, wherein said high iodide phase is at a position facing a corner, an edge, a (111) face or a (110) face.

5. The photographic product of claim 1, wherein said regular crystal grains each have an internal high iodide phase having an average iodide content of not less than 7 mol % and accounting for 0.1 to 15% of the grain volume.

6. The photographic product of claim 2, wherein said high iodide phase has a thickness of not more than 0.1 μm.

7. The photographic product of claim 1, wherein in said silver halide emulsion, said regular crystal grains each have dislocation lines which are oriented toward the surface of the grain.

8. The photographic product of claim 7, wherein said silver halide grains have at least 10 dislocation lines per grain, at least 60% of the dislocation lines being oriented toward the (100) face of the grain.

9. The photographic product of claim 7, wherein said silver halide grains have at least 10 dislocation lines per grain, at least 60% of the dislocation lines of the grain being oriented toward a corner, an edge, a (111) face or a (110) face of the grain.

10. The photographic product of claim 1, wherein said regular crystal grains exhibit a variation coefficient of grain size of not more than 20%.

11. The photographic product of claim 1, wherein when the container is ruptured, the processing composition is distributed between the photosensitive element and the image-receiving element.

12. The photographic product of claim 1, wherein the processing composition exhibits a pH of not less than 12.

* * * * *